US006418677B1

(12) United States Patent
Goto

(10) Patent No.: US 6,418,677 B1
(45) Date of Patent: Jul. 16, 2002

(54) JOINT DEVICE FOR FLOOR

(75) Inventor: Hideo Goto, Kuwana (JP)

(73) Assignee: Doei Gaiso Yugen Gaisha, Mie-ken (JP)

( * ) Notice: Subject to any disclaimer, the term of this patent is extended or adjusted under 35 U.S.C. 154(b) by 0 days.

(21) Appl. No.: 09/660,658

(22) Filed: Sep. 13, 2000

(51) Int. Cl.[7] ..... E04H 9/16

(52) U.S. Cl. ..... 52/167.1; 52/167.4; 52/167.5; 52/396.04

(58) Field of Search ..... 52/167.1, 167.4, 52/167.5, 396.04, 473, DIG. 14; 160/21, 30

(56) References Cited

U.S. PATENT DOCUMENTS 1,960,860 A * 5/1934 Allen ..... 52/396.04
2,210,869 A * 8/1940 Larson ..... 52/396.04
2,544,008 A * 3/1951 Coleman ..... 52/396.04
3,183,626 A * 5/1965 Schmitt ..... 52/396.04
3,526,066 A * 9/1970 Hagar et al. ..... 52/396.05
3,797,952 A * 3/1974 Pommerening et al. ..... 404/52
3,919,814 A * 11/1975 Beretta et al. ..... 52/90
4,087,191 A * 5/1978 Brady et al. ..... 404/69
4,557,082 A * 12/1985 Dunsworth ..... 52/109
5,306,210 A * 4/1994 Smit ..... 454/250
5,400,559 A * 3/1995 Nicholas ..... 52/396.05
5,644,879 A * 7/1997 Shreiner et al. ..... 52/393
5,778,598 A * 7/1998 Ohanesian ..... 49/74.1
5,887,308 A * 3/1999 Walter ..... 14/73.1

* cited by examiner

*Primary Examiner*—Carl D. Friedman
*Assistant Examiner*—Phi Dieu Tran A
(74) *Attorney, Agent, or Firm*—Jordan and Hamburg LLP

(57) ABSTRACT

A joint cover includes rails attached to the right and left building portions adjacent sides of the joint parts between the right and left building members. At least two or more support members are disposed across a joint gap at a sloping state, both ends thereof being supported movably by the rails attached to the side walls pairs. A plurality of support bars for retaining joint plates is provided pivotably at a fixed interval on the support members. The plurality of joint plates is attached to the support bars respectively, each joint plate being overlapping at a fixed width and being maintaining a overlapping state when the width of the joint gap between the two building members expands or contracts, so that the transportation and assembly operation can be done efficiently, and the joint cover can move smoothly following swing and oscillation movement due to earthquake, or the like.

12 Claims, 37 Drawing Sheets

JOINT DEVICE FOR FLOOR

BACKGROUND OF THE INVENTION

The present invention relates generally to a joint device, especially for a floor surface covering and for concealing a joint between right and left building portions defining the joint.

The conventional joint device, especially for a floor surface, covers a joint of right and left building portions with one joint plate.

Concerning the above-mentioned joint device, in the case of buildings with a structure having the earthquake-resistance structures, the range for absorbing vibration is large and the size of the joint plate is too big, so that the transportation and assembly operation is not facilitated. In addition, the weight of the joint plate increases after all because the armature is used in order to obtain the strength of the joint plate, the cost raises up.

SUMMARY OF THE INVENTION

Accordingly, it is an object of the present invention to provide a joint device that can transport and operate easily.

It is another object of the present invention to provide a joint device that can follow a large vibration, swing or oscillation movement smoothly due to earthquake, or the like.

The novel features which are believed to be characteristic of the invention, both as to its organization and method of operation, together with further objects and advantages thereof, are described below with reference to the accompanying drawings in which a presently preferred embodiment of the invention is illustrated as an example.

It is to be expressly understood, however, that the drawings are for the purpose of illustration and description only, and are not intended as a definition of the limits of the invention.

DETAILED DESCRIPTION

Figure 1:
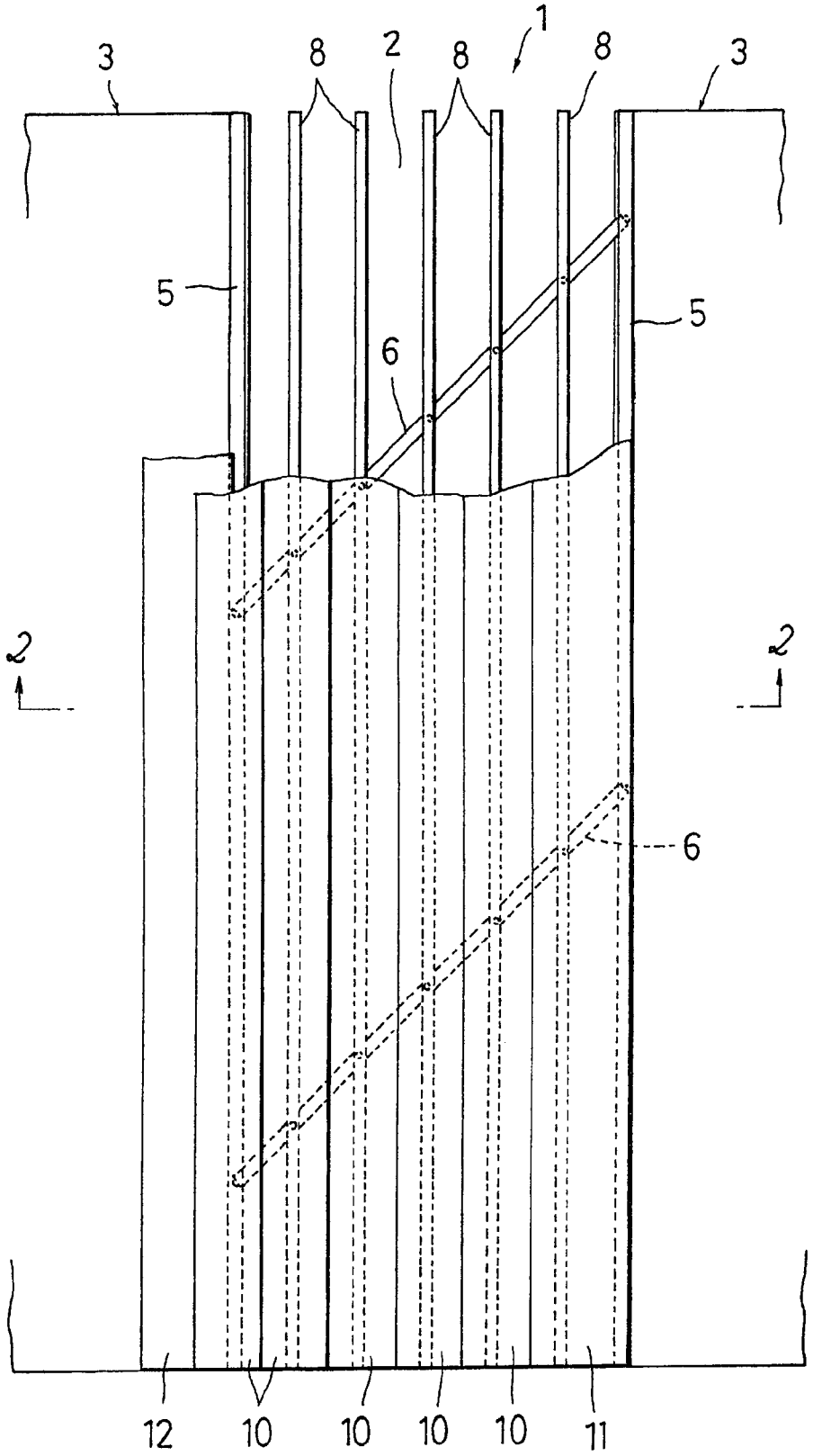
FIG. 1 is a partial cross-sectional plan view showing a first embodiment of the present invention.
Figure 2:
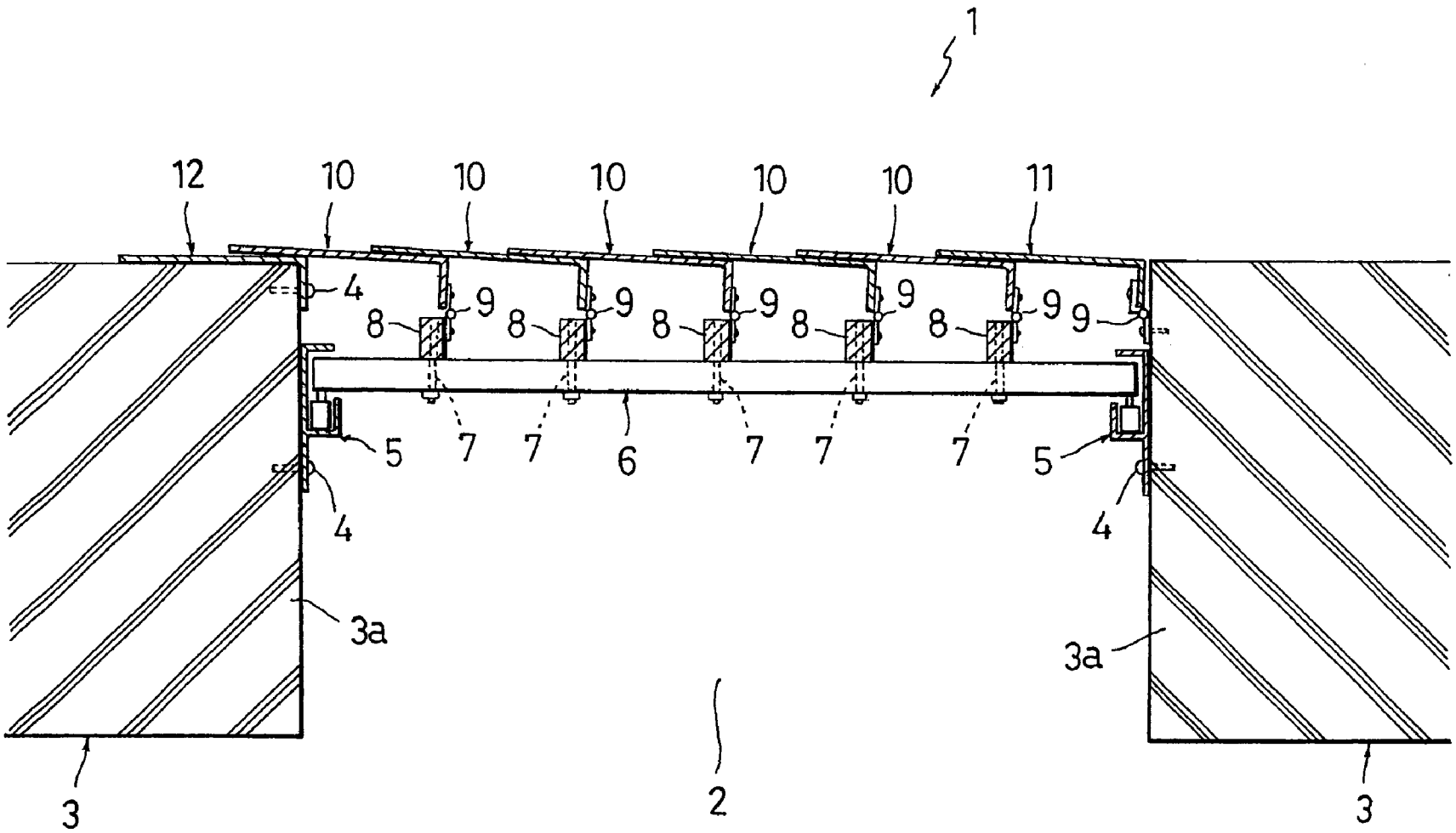
FIG. 2 is an expanded cross-sectional view taken along the line 2—2 of FIG. 1.

Preferred embodiments of the present invention are described in more detail below referring to the accompanying drawings.

An understanding of the present invention may be best gained by reference FIGS. 1 to 10. FIGS. 1 to 10 illustrate a joint device 1 for floor of a first embodiment of the present invention. The joint device 1 covers a joint part 2 of a floor surfaces of right and left building members 3,3 defining the joint part 2 and comprises rails 5,5, a plurality of support bars 6, a plurality of support bars 8 for retaining joint plates 10, the plurality of joint plates 10, an end joint plate 11 and a support plate 12.

The rails 5,5 are attached respectively to the right and left bodies 3*a*, 3*a*, adjacent sides of the joint parts 2 between the right and left building members 3,3 by a plurality of screws 4, or the like, so as to provide at a horizontal state.

The support bars 6, for example at least two support bars or more, are arranged and supported slidably by the rails 5 on both ends thereof in a fixed sloping angle, for example a 45 degree angle on inclination.

The support bars 8 are pivotably attached to the support bars 6 by pivot pins 7 at a fixed interval.

The joint plates 10 are attached to the support bars by hinge members 9 respectively. One joint plate 10 overlaps the other joint plate 10 that is adjoining the joint plate at a fixed width. When the width of the joint part 2 between two buildings 3,3 expands or contracts, the amount of overlapping width changes and the overlapping state is still maintained.

The end joint plate 11 is attached to the body 3*a* of the joint part side of one of the building member 3 by the hinge members 9 and formed at a substantially same shape of the joint plate The end joint plate 11 overlaps one end of the joint plate 10 at a fixed width.

The support plate 12 is fixed to the body 3*a* of the joint part side of the other building member 3 by the screws 4 formed at a substantially same shape of the joint plate 10. The support plate 12 overlaps the other end of the joint plate 10.

Figure 3:
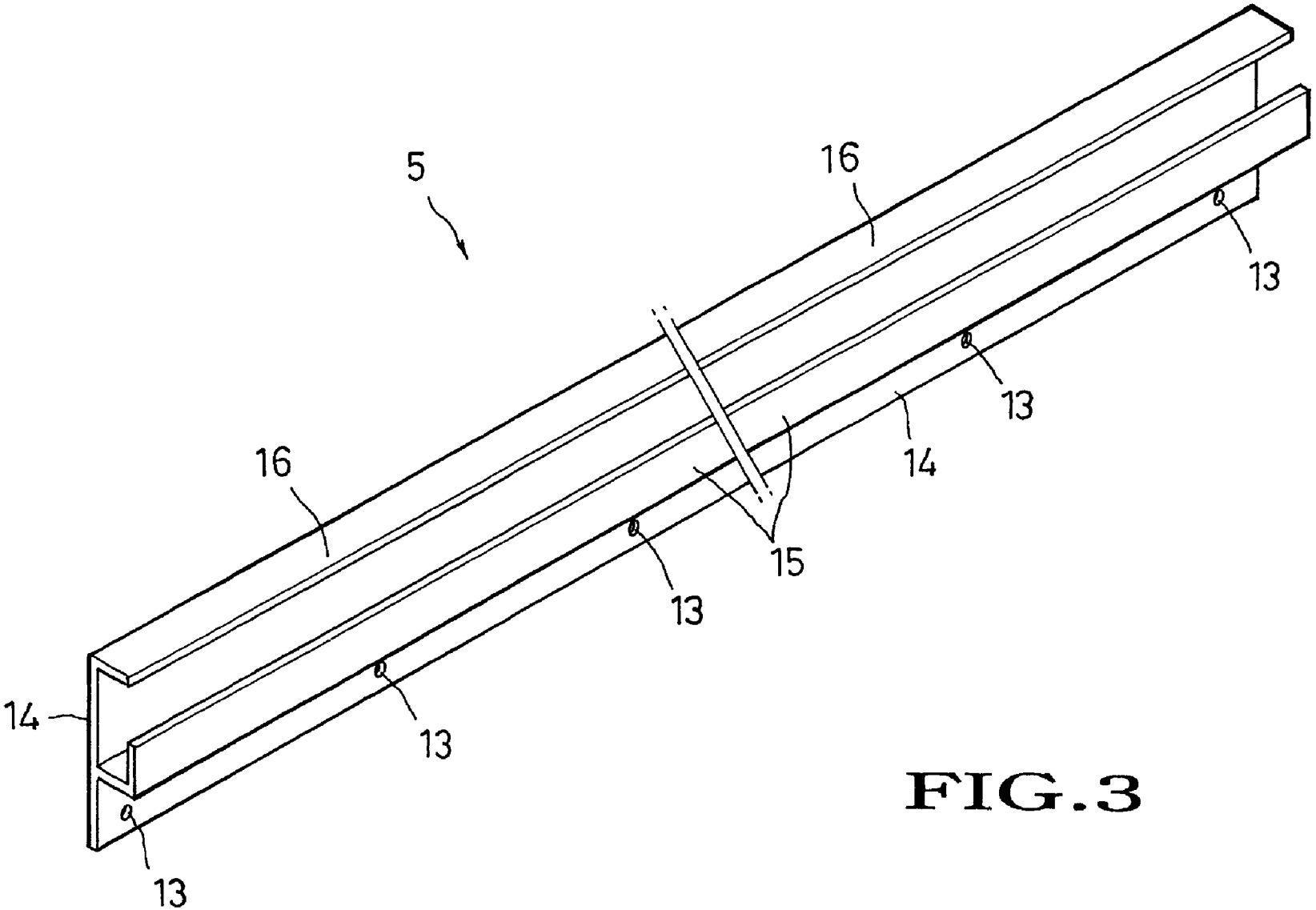
FIG. 3 is an explanatory view of a rail of the first embodiment of the present invention.

The rail 5, as shown in FIG. 3, further includes a base plate 14, rail part 15 and stopper 16. The base plate 14 has holes 13 on a bottom portion thereof at a fixed interval. The rail part 15 is provided so as to protrude in the shape of L-letter at a substantially center portion of the side of the base plate 14. The stopper 16 is provided so as to protrude on an upper part of the base plate 14 in a horizontal direction.

Figure 4:
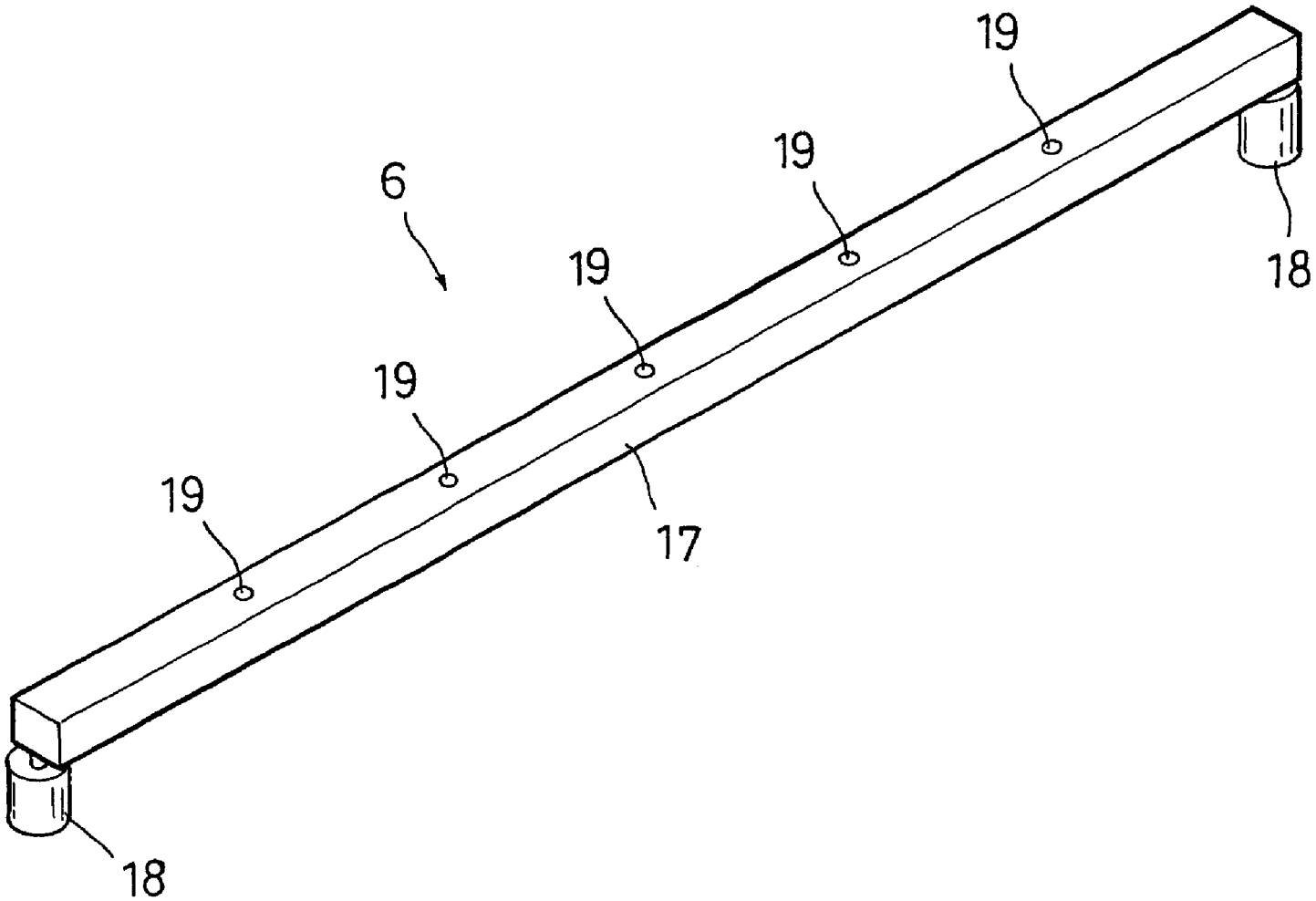
FIG. 4 is an explanatory view of a support bar of the first embodiment of the present invention.

The support bar 6, as shown in FIG. 4, further includes a support bar body 17, rollers 18,18 and holes 19. The support bar body 17 is a pipe of a square shape. In detail, the support bar 6 has the rollers 18,18 at both ends on a bottom surface thereof and the holes 19 at a substantially center part thereof at a fixed interval.

Figure 5:
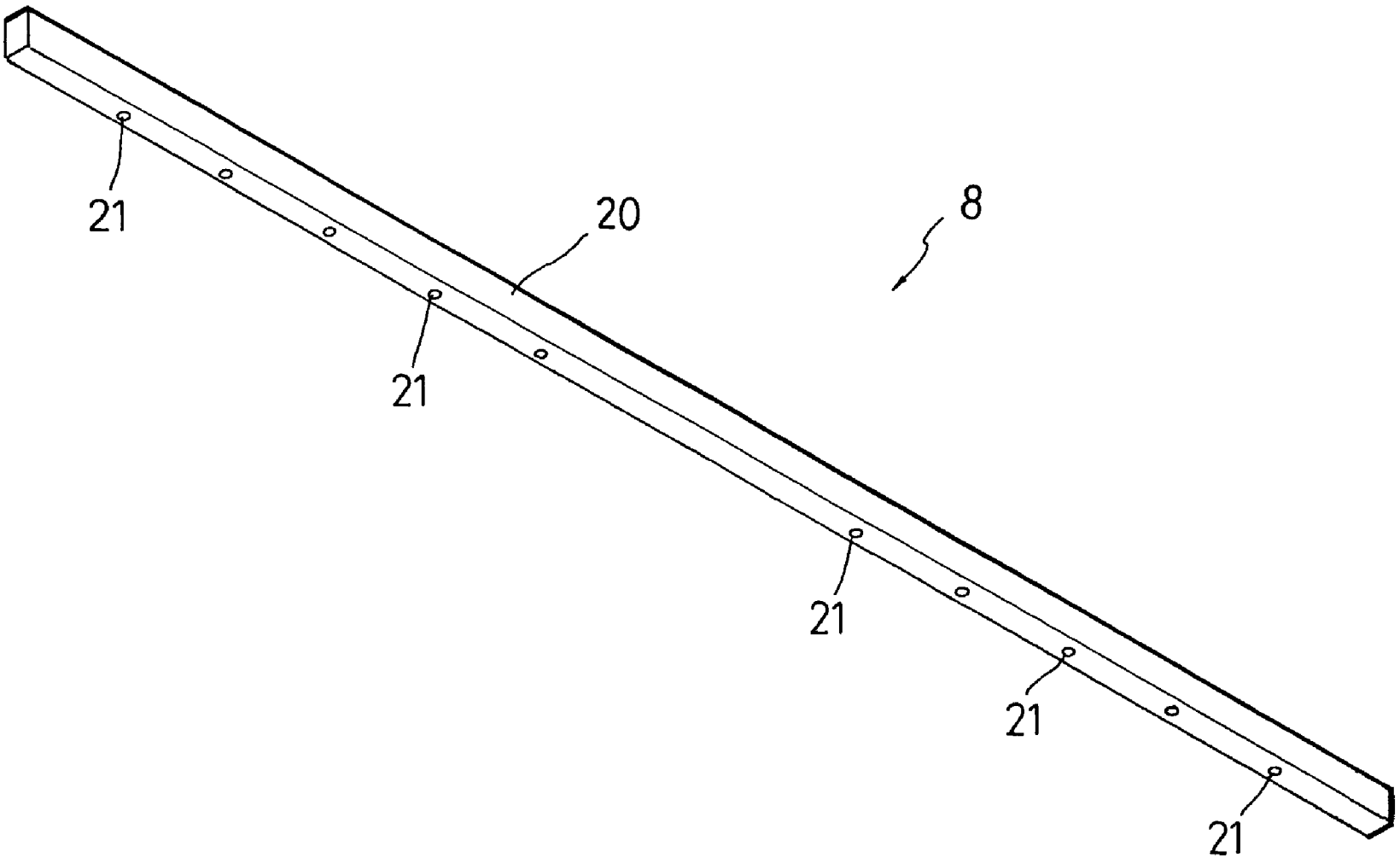
FIG. 5 is an explanatory view of a support bar of a joint plate of the first embodiment of the is an explanatory view of the joint plate of the first embodiment of the present

The support bar 8, as shown in FIG. 5, further includes support bar body 20 and holes 21. The support bar body 20 is a pipe of a square shape. The support bar 8 includes the holes 21 at a substantially center part thereof, being engaged by the pivot pins 7, the hole 21 passing through the hole 19 of the support bar 6.

Figure 6:
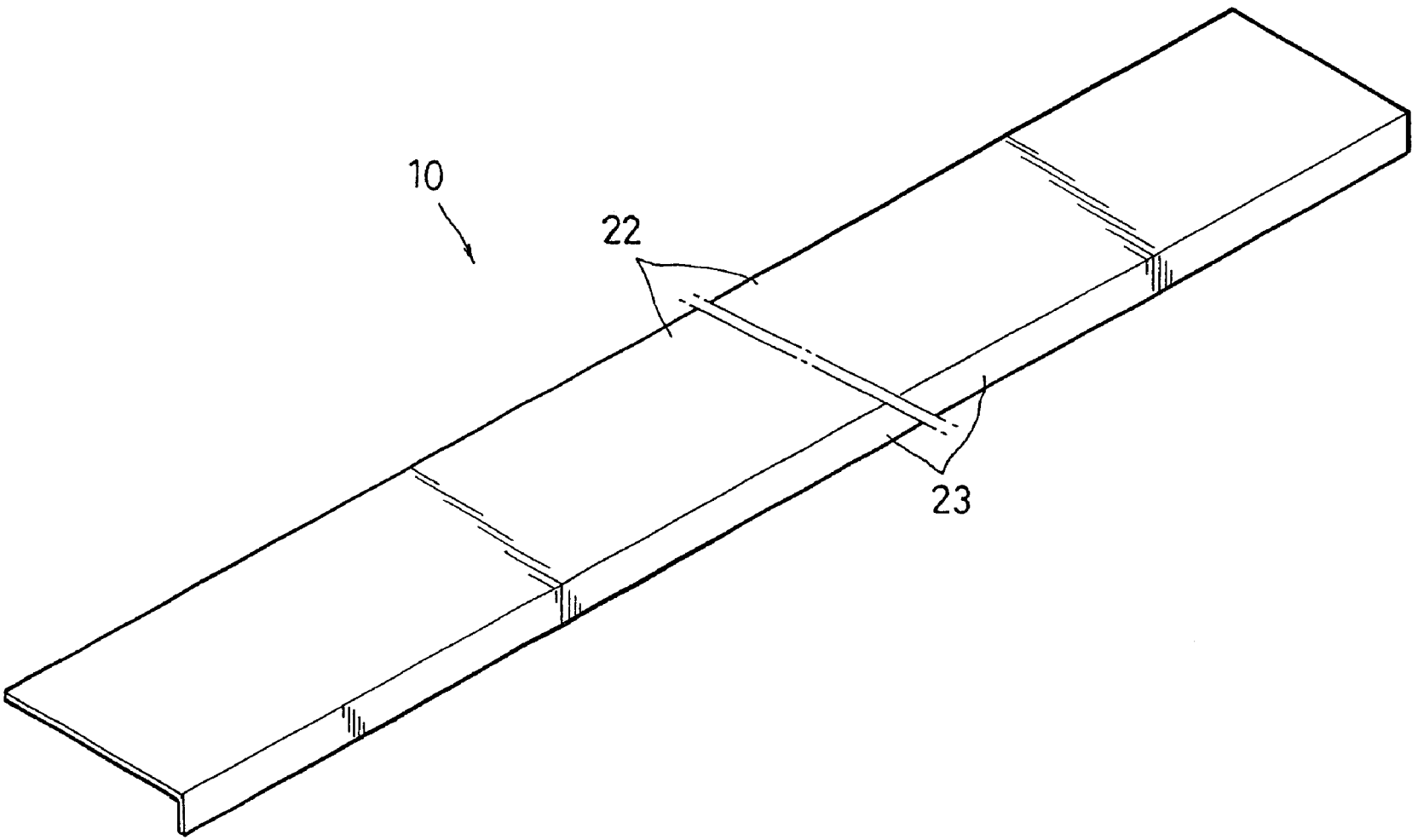

The joint plate 10, as shown in FIG. 6, further includes joint plate body 22 which is formed in the shape of a plate and projection 23. The joint plate body 22 includes the projection 23 at one end thereof so as to protrude downward.

Figure 7:
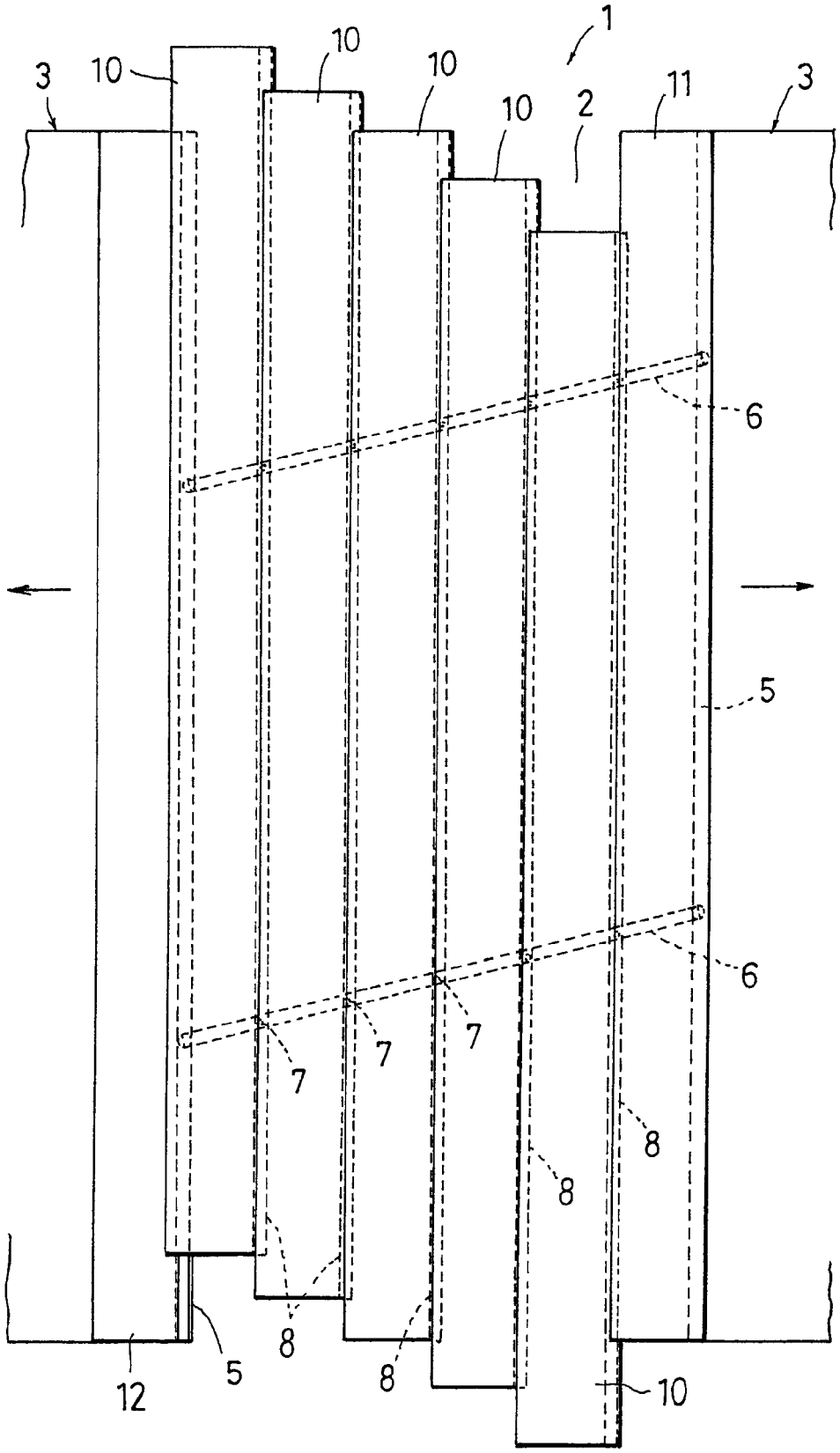
FIG. 7 is a plan view showing joint expansion according to the first embodiment of the present invention.
Figure 8:
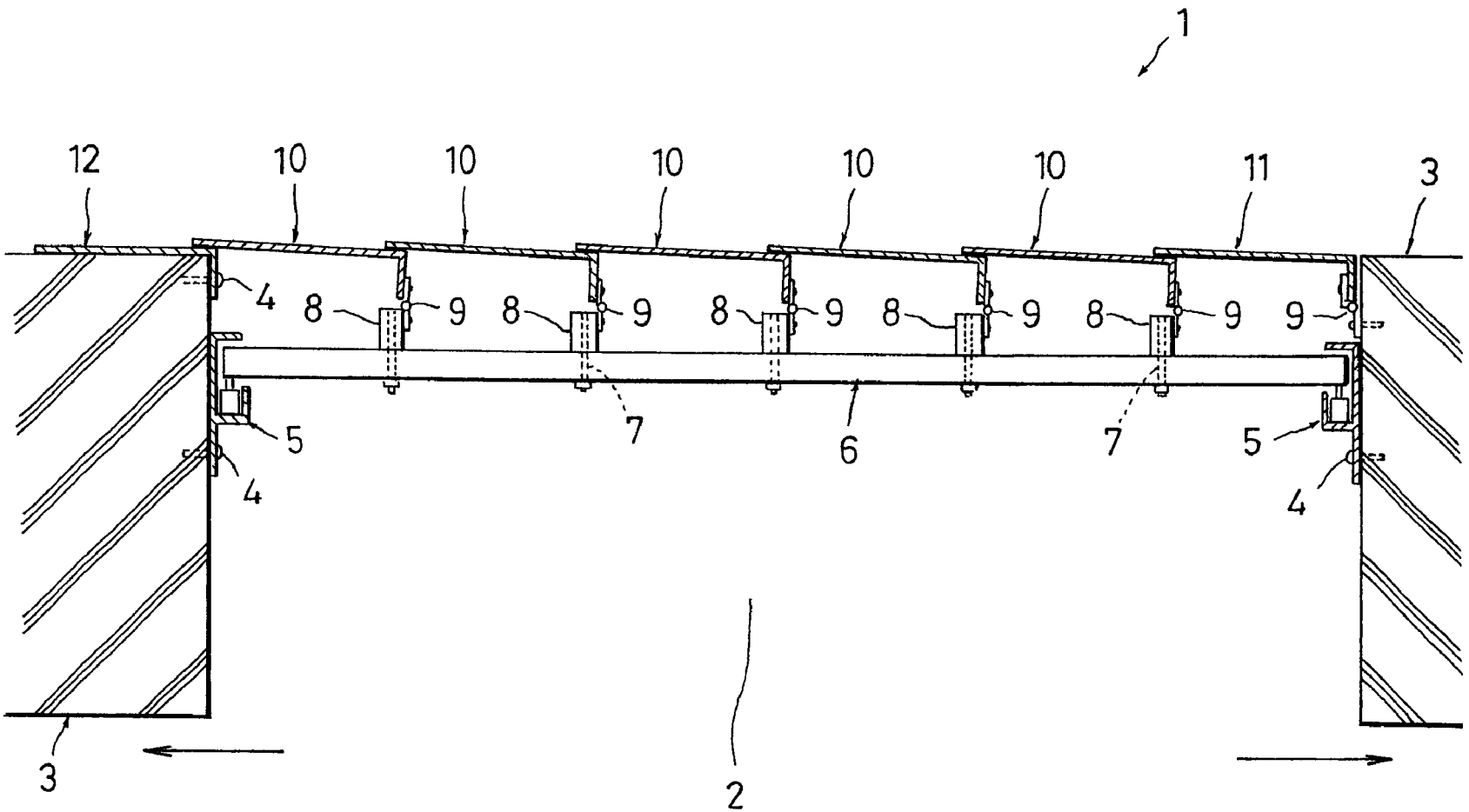
FIG. 8 is a cross-sectional view showing joint expansion according to the first embodiment of the present invention.

In the above joint device 1, when the right and left building members 3,3 are oscillated by an earthquake, or the like, such that the width of the joint part 2 between two building member 3,3 expands, the plurality of support bars 6, as shown in FIGS. 7 and 8, move along the rails 5,5 so as to provide straightly in the right-left direction. Therefore, the support bars 8 move pivotably and slidably such that the interval spaced between the support bars 8 become larger, and the overlapping width of each joint plate 10 become smaller due to a slidable moving of the support bars 8, so that the joint device 1 absorbs the oscillation movement leaving no space between two building members 3,3.

Figure 9:
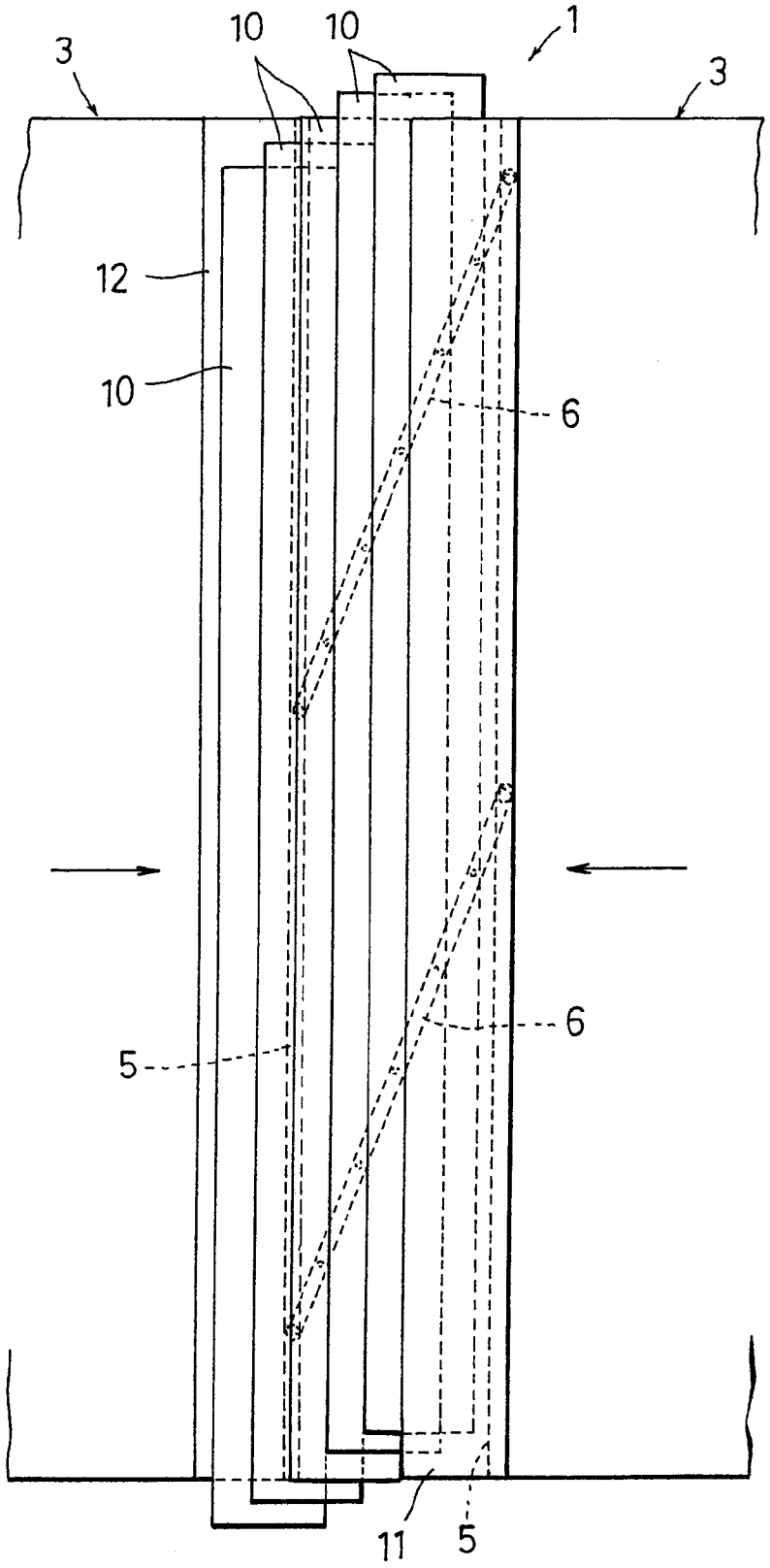
FIG. 9 is a plan view showing joint contraction according to the first embodiment of the present invention.
Figure 10:
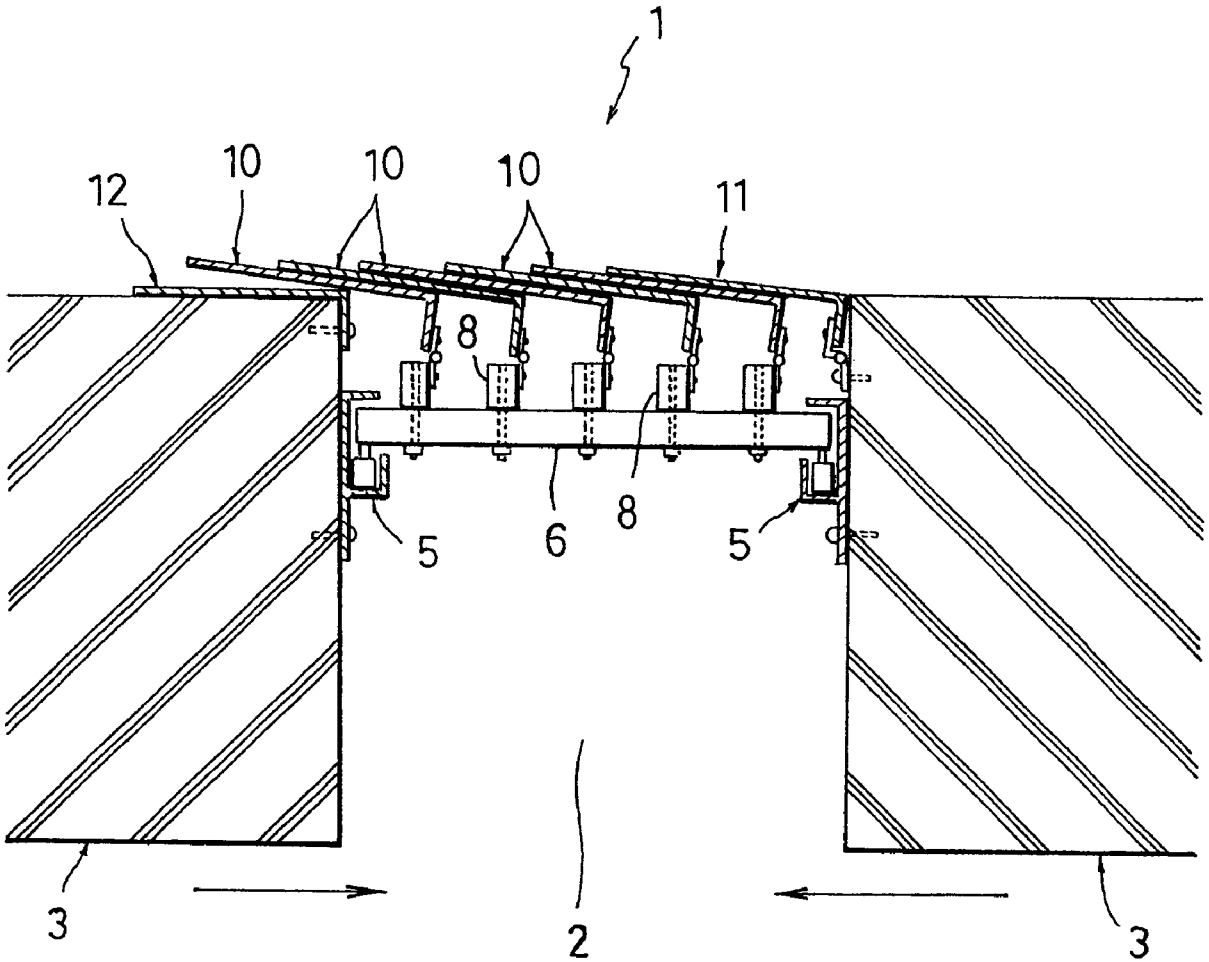
FIG. 10 is a cross-sectional view showing joint contraction according to the first embodiment of the present invention.

When the right and left building members 3,3 are oscillated by an earthquake, or the like, such that the width of the joint part 2 between two building members 3,3 contracts, the plurality of support bars 6, as shown in FIGS. 9 and 10, move along the rails 5,5 such that the interval spaced between the support bars 8 become smaller, and the overlapping width of each joint plate 10 become bigger due to a slidable moving of the support bars 8, so that the joint device 1 absorbs the oscillation movement, and damage of joint plate 10, or the like is prevented.

Other embodiments of the present invention will now be described referring to FIGS. 11 to 37. Through the drawings of the embodiments, like components are denoted by like numerals as of the first embodiment and will not be further explained in great detail.

Figure 11:
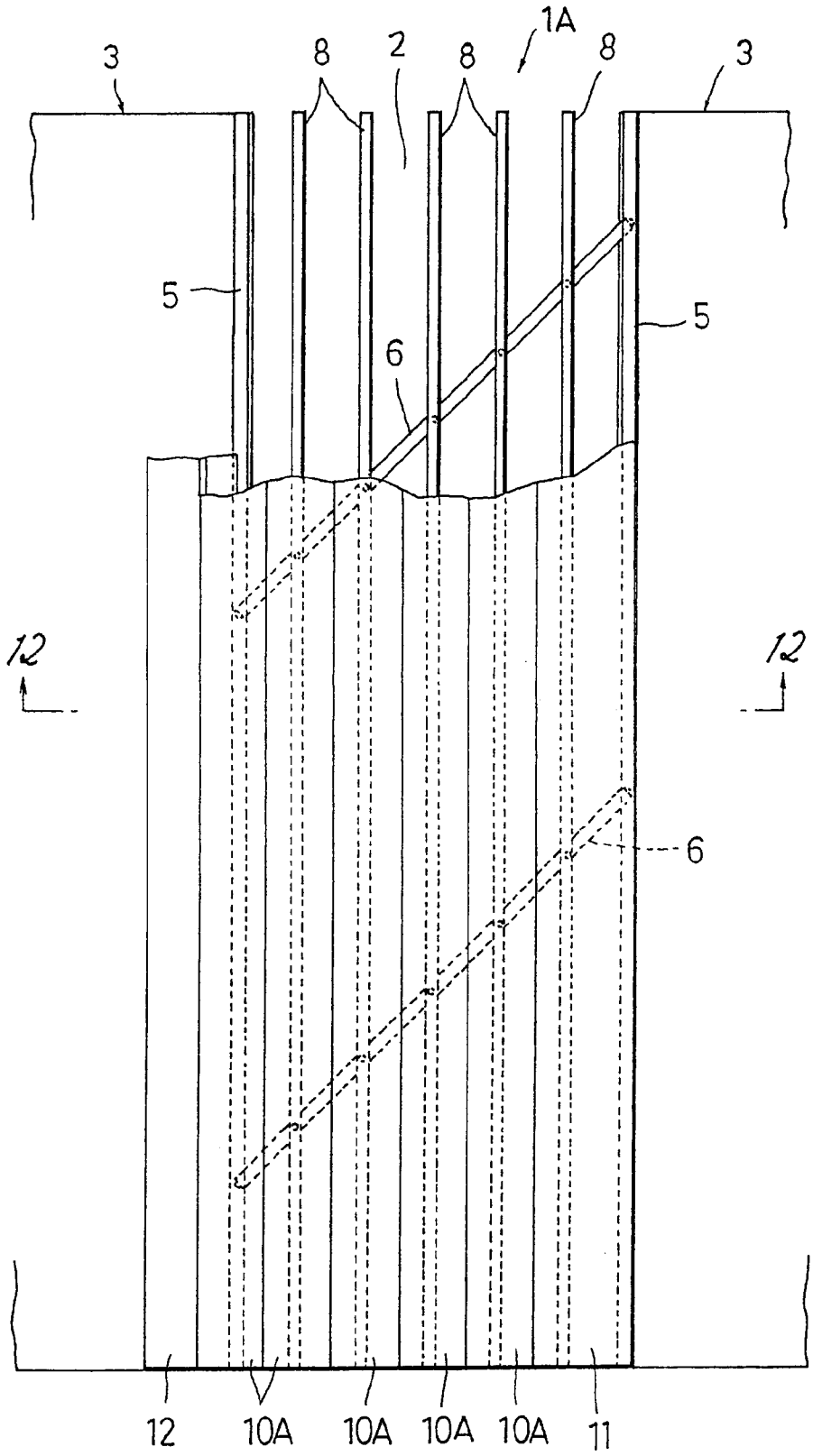
FIG. 11 is a partial cross-sectional plan view showing a second embodiment of the present invention.
Figure 12:
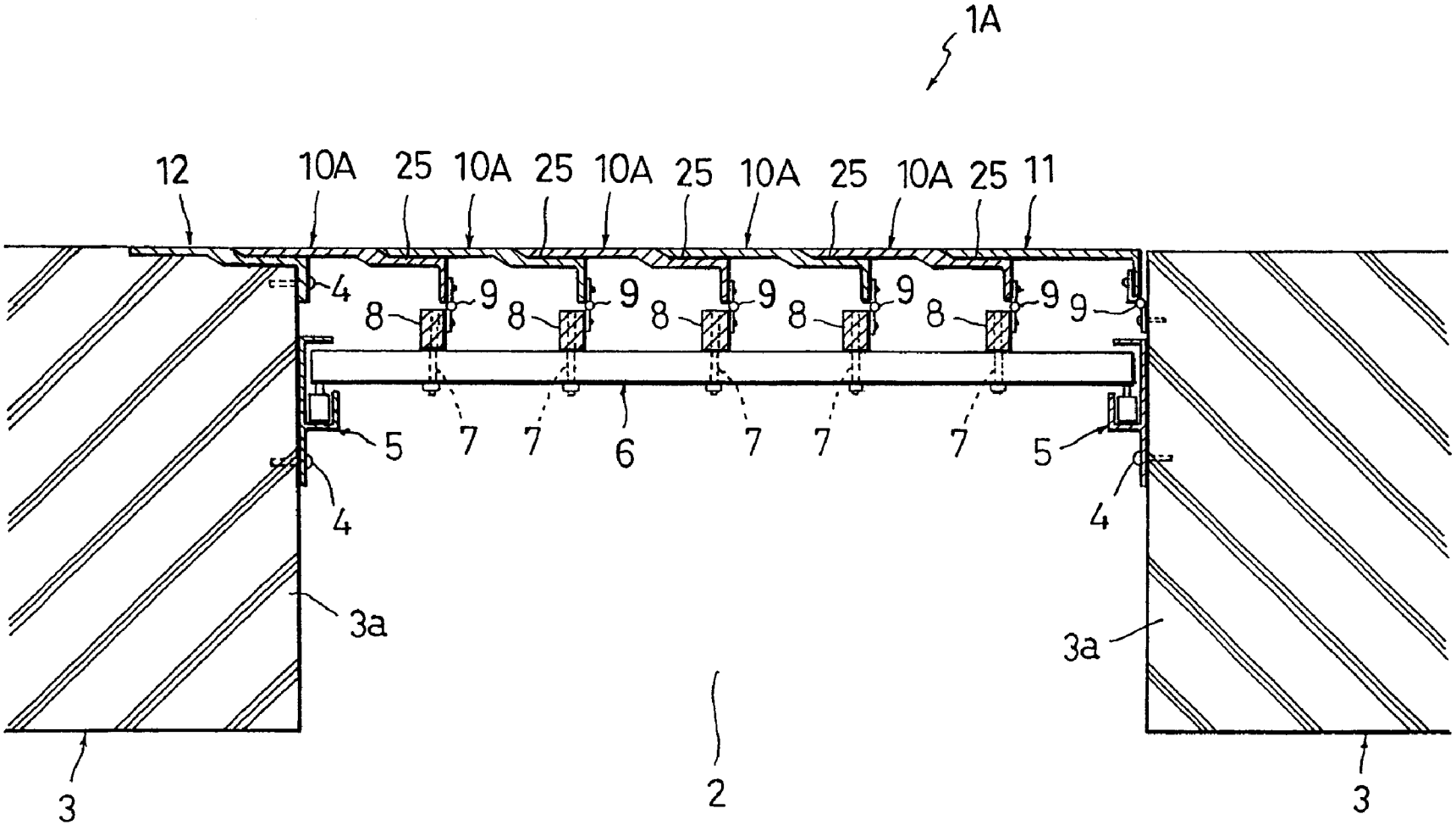
FIG. 12 is an expanded cross-sectional view taken along the line 12—12 of FIG. 11.
Figure 13:
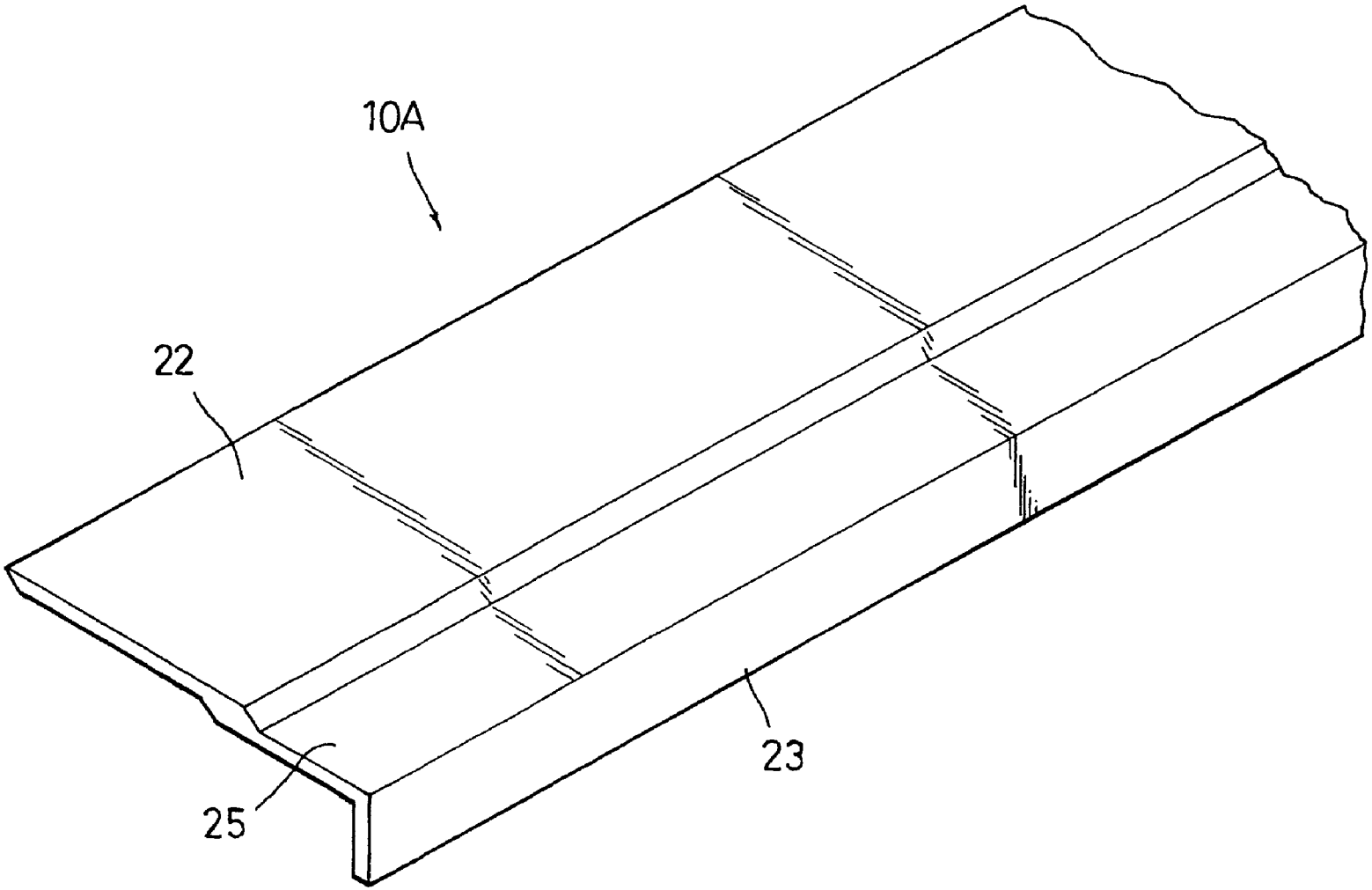
FIG. 13 is an explanatory view of a joint plate of the second embodiment of the present invention.

A second embodiment of the present invention is shown in FIGS. 11 to 13. It is distinguished from the first embodiment by the fact that a plurality of joint plates 10A includes a sloping surface 24 formed on a bottom surface thereof and a recessed portion 25. The recessed portion 25 is formed in the shape of a plain on an upper surface thereof, the upper surface being overlapping the end of another joint plate 10A. A joint device 1A with the joint plates 10A according to the second embodiment has similar advantages to that according to the first embodiment, and the device 1A is provided a plain upper surface.

Figure 14:
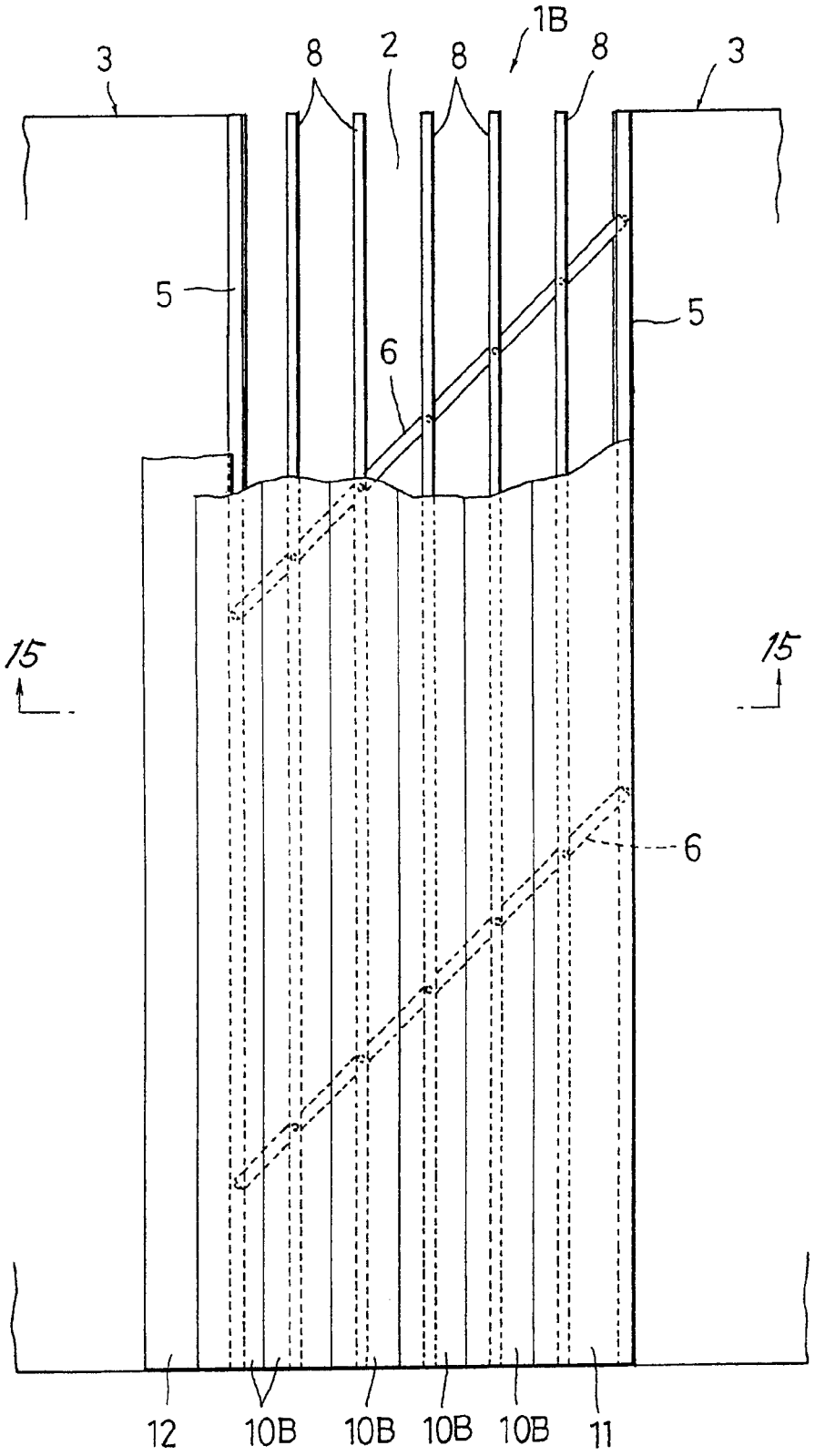
FIG. 14 is a partial cross-sectional plan view showing a third embodiment of the present invention.
Figure 15:
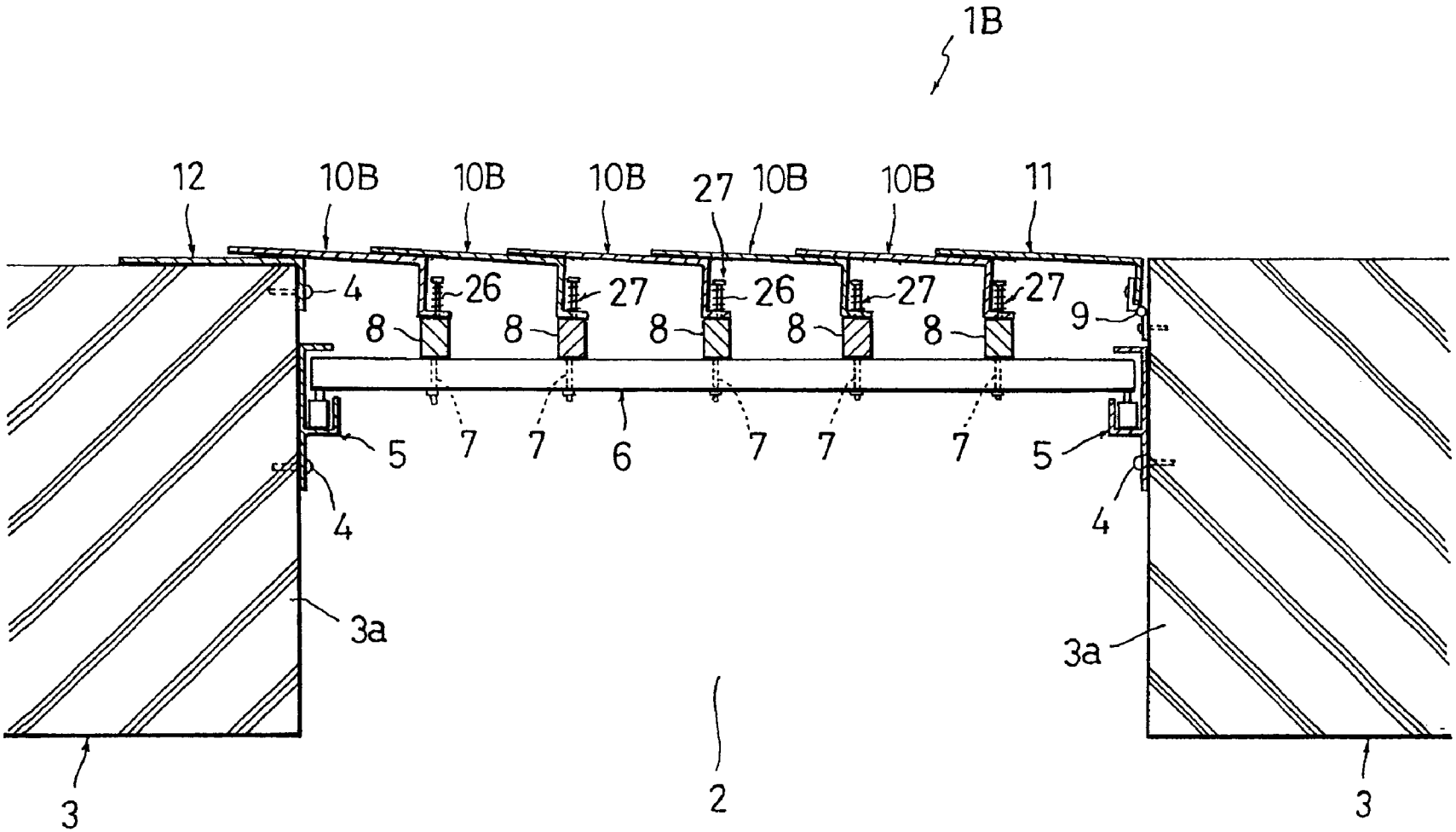
FIG. 15 is an expanded cross-sectional view taken along the line 15—15 of FIG. 14.
Figure 16:
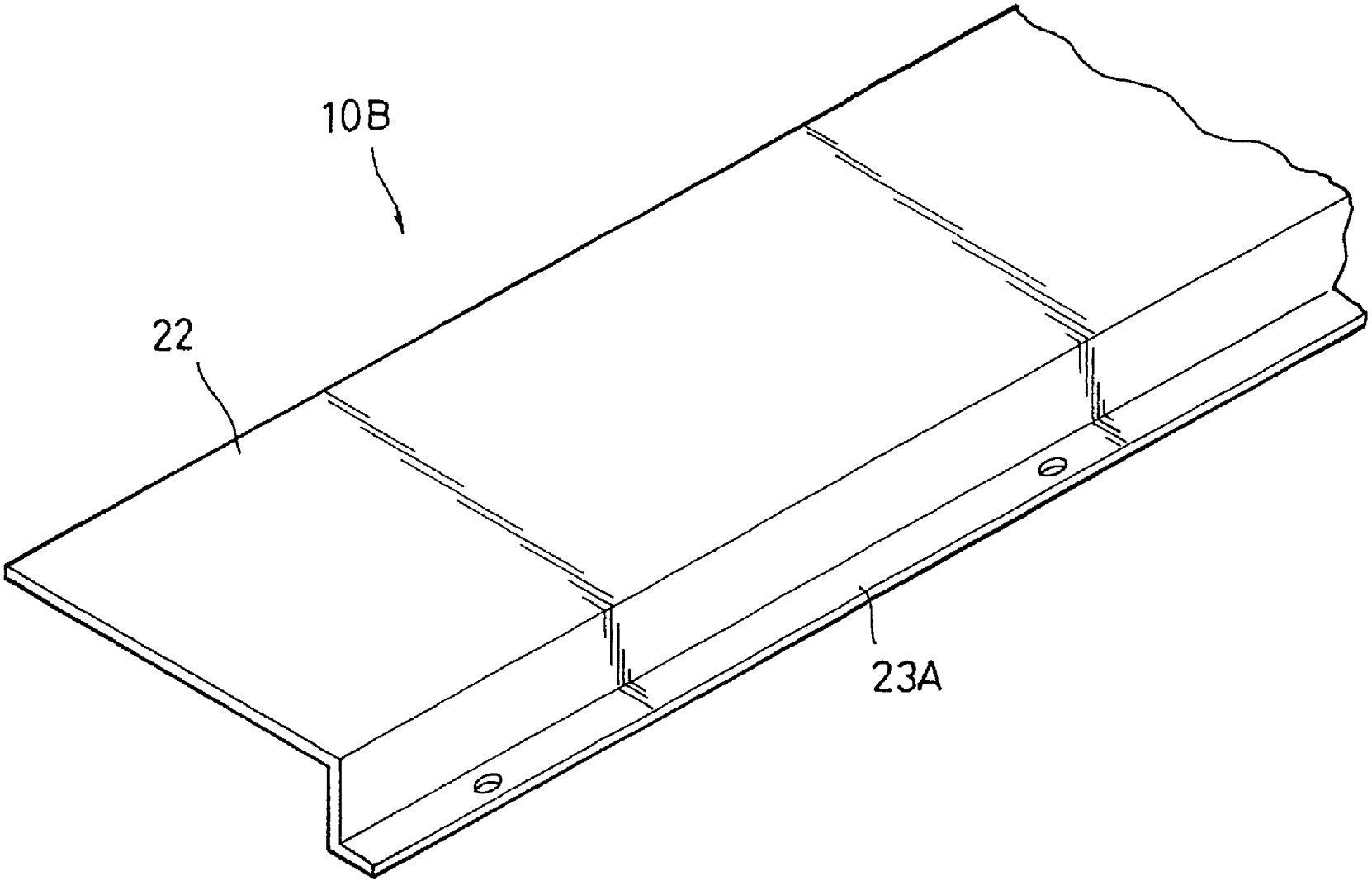
FIG. 16 is an explanatory view of a joint plate of the third embodiment of the present invention.

A third embodiment of the present invention is shown in FIGS. 14 to 16. It is distinguished from the first embodiment by the fact that a plurality of joint plates 10B includes a projection 23A formed in the shape of L-letter. The projection 23A is attached to the support bar 8 through the attachment member 27 including a bolt and biased by a spring 26. A joint device 1B formed in this way according to the third embodiment has similar advantages to that according to the first embodiment.

Figure 17:
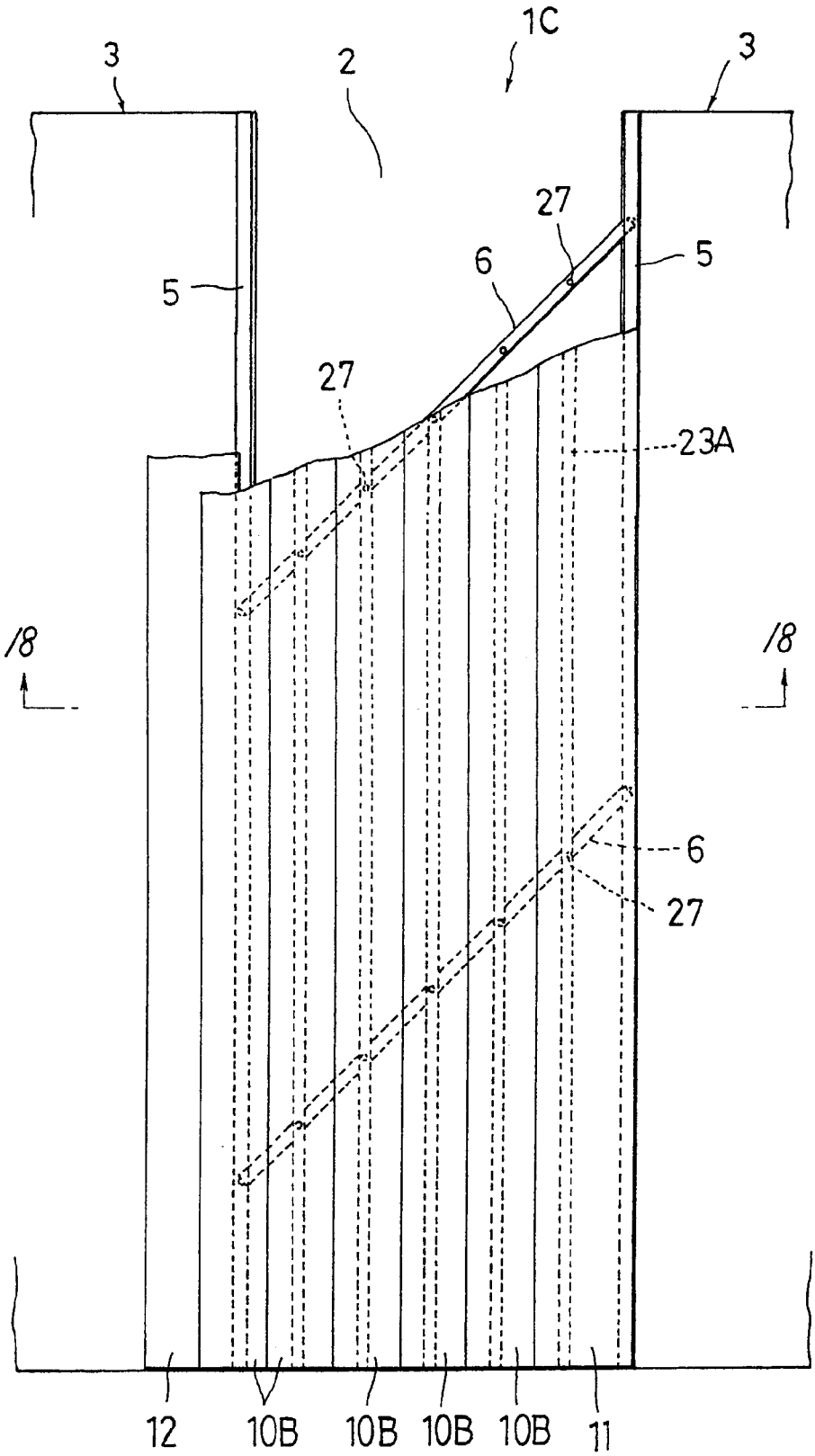
FIG. 17 is a partial cross-sectional plan view showing a fourth embodiment of the present invention.
Figure 18:
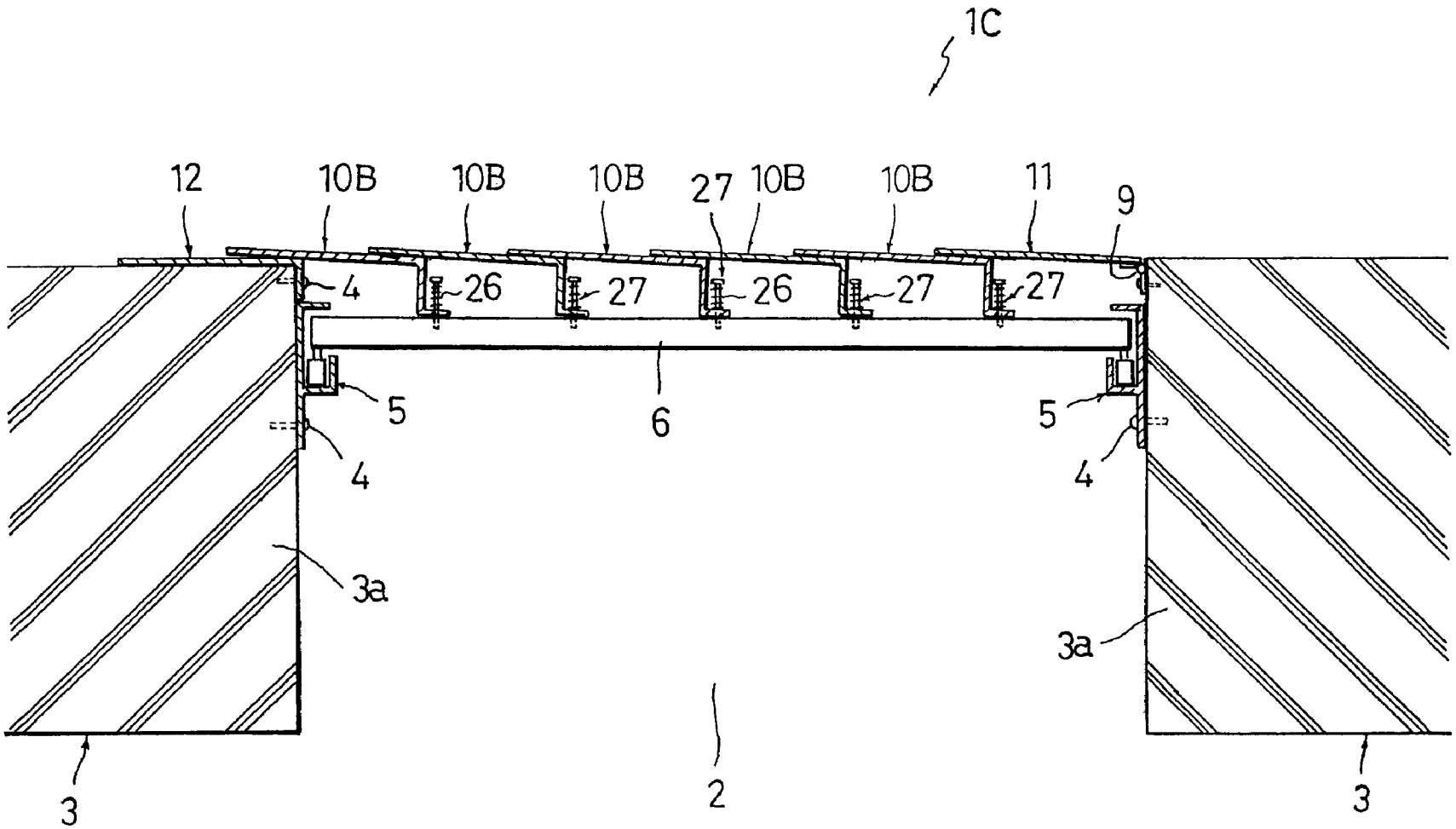
FIG. 18 is an expanded cross-sectional view taken along the line 18—18 of FIG. 17.
Figure 19:
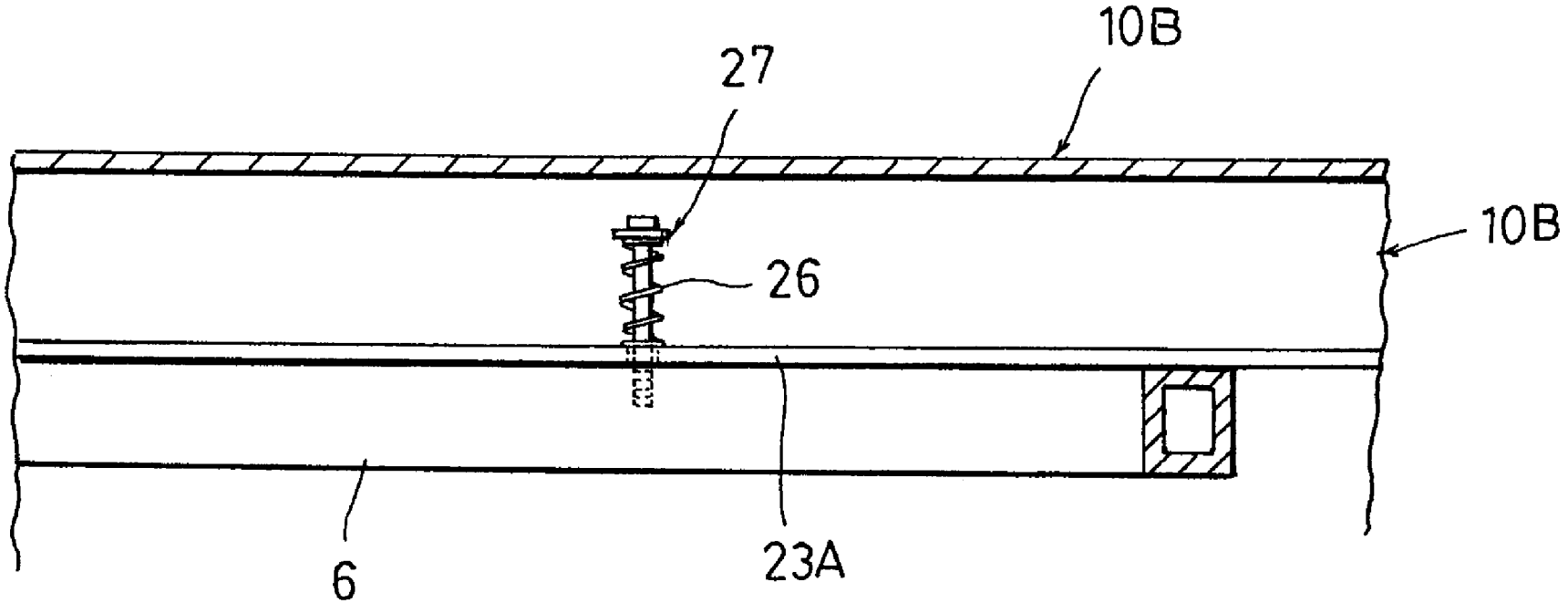
FIG. 19 is a mainly expanded cross-sectional plan view showing the fourth embodiment of the present invention.

A fourth embodiment of the present invention is shown in FIGS. 17 to 19. It is distinguished from the third embodiment by the fact that the projection 23A is attached pivotably to the support bar 6 by the attachment member 27 including the bolt and biased by a spring 26. A joint device 1C formed in this way according to the fourth embodiment has similar advantages to that according to the third embodiment, and the support bar for joint plate becomes unserviceable. Therefore, structure is simple and the reliability is achieved.

Figure 20:
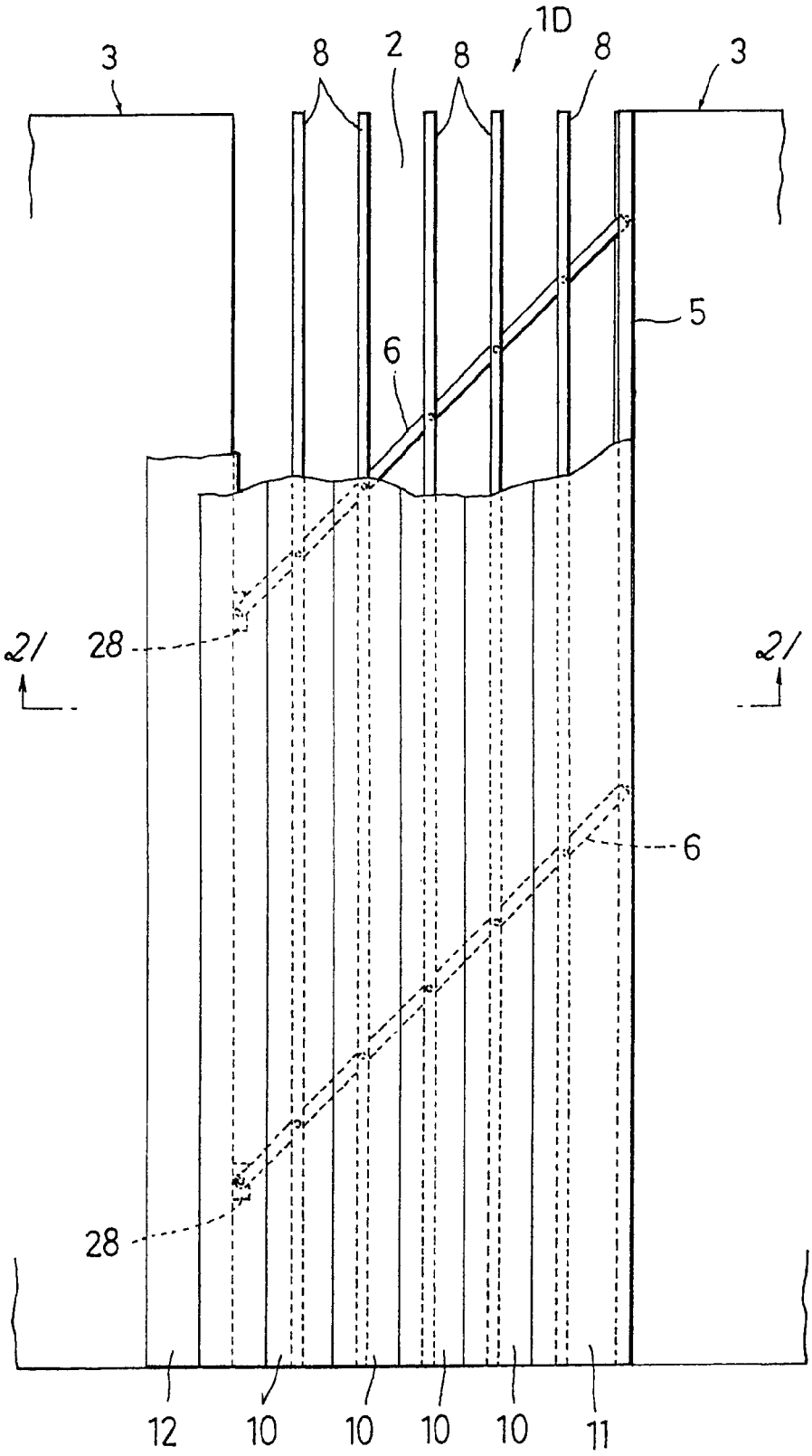
FIG. 20 is a partial cross-sectional plan view showing a fifth embodiment of the present invention.
Figure 21:
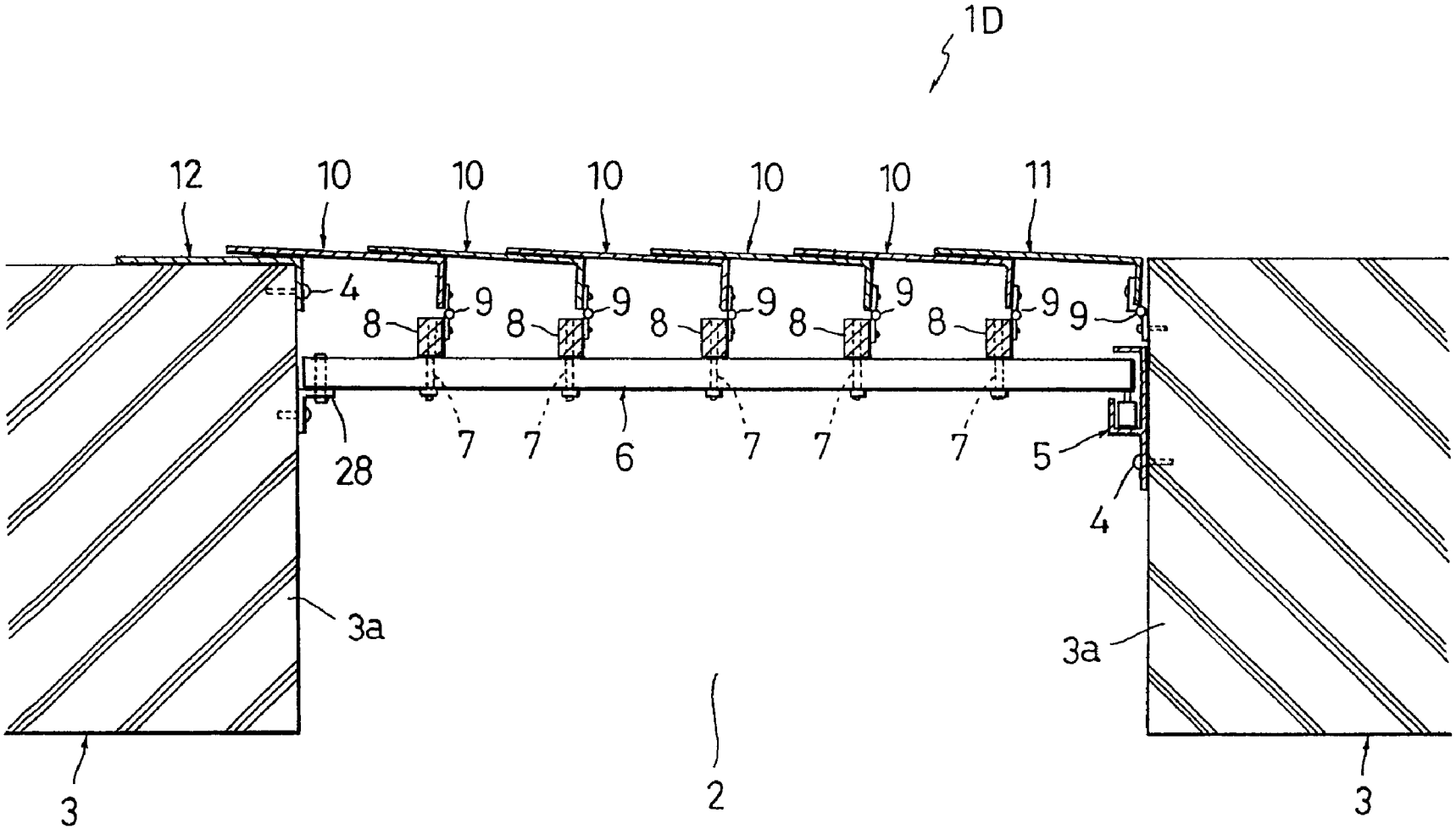
FIG. 21 is an expanded cross-sectional view taken along the line 21—21 of FIG. 20.
Figure 22:
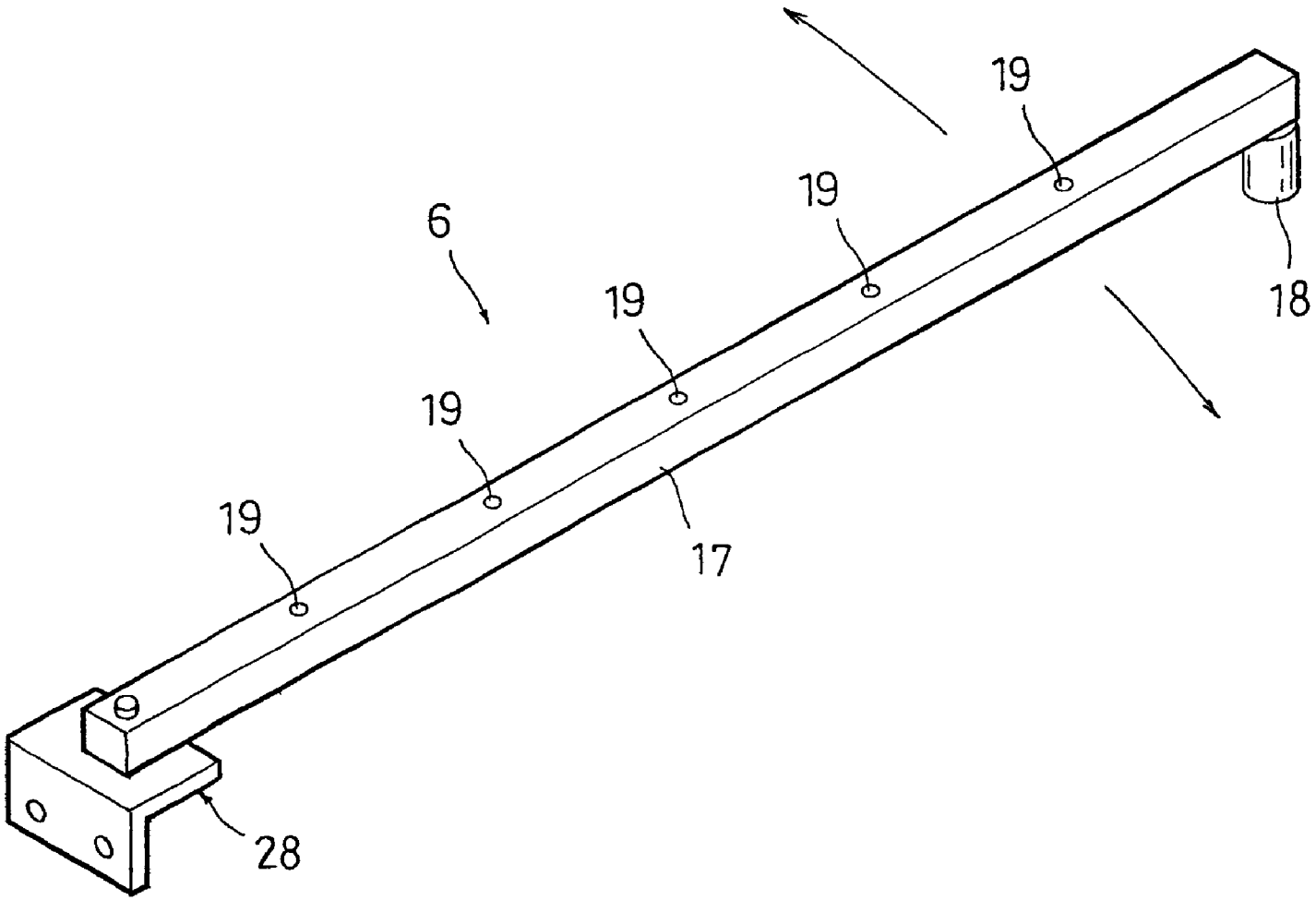
FIG. 22 is an explanatory view of a support bar of the fifth embodiment of the present invention.

A fifth embodiment of the present invention is shown in FIGS. 20 to 22. It is distinguished from the first embodiment by the fact that the plurality of support bars 6 is attached to the building portion 3*a* of the joint part side of one of building member 3 on one end thereof by an attachment member 28, and another end of the support bar 6 moves rotatably in a horizontal direction. A joint device 1D formed in this way according to the fifth embodiment has similar advantages to that according to the first embodiment.

Figure 23:
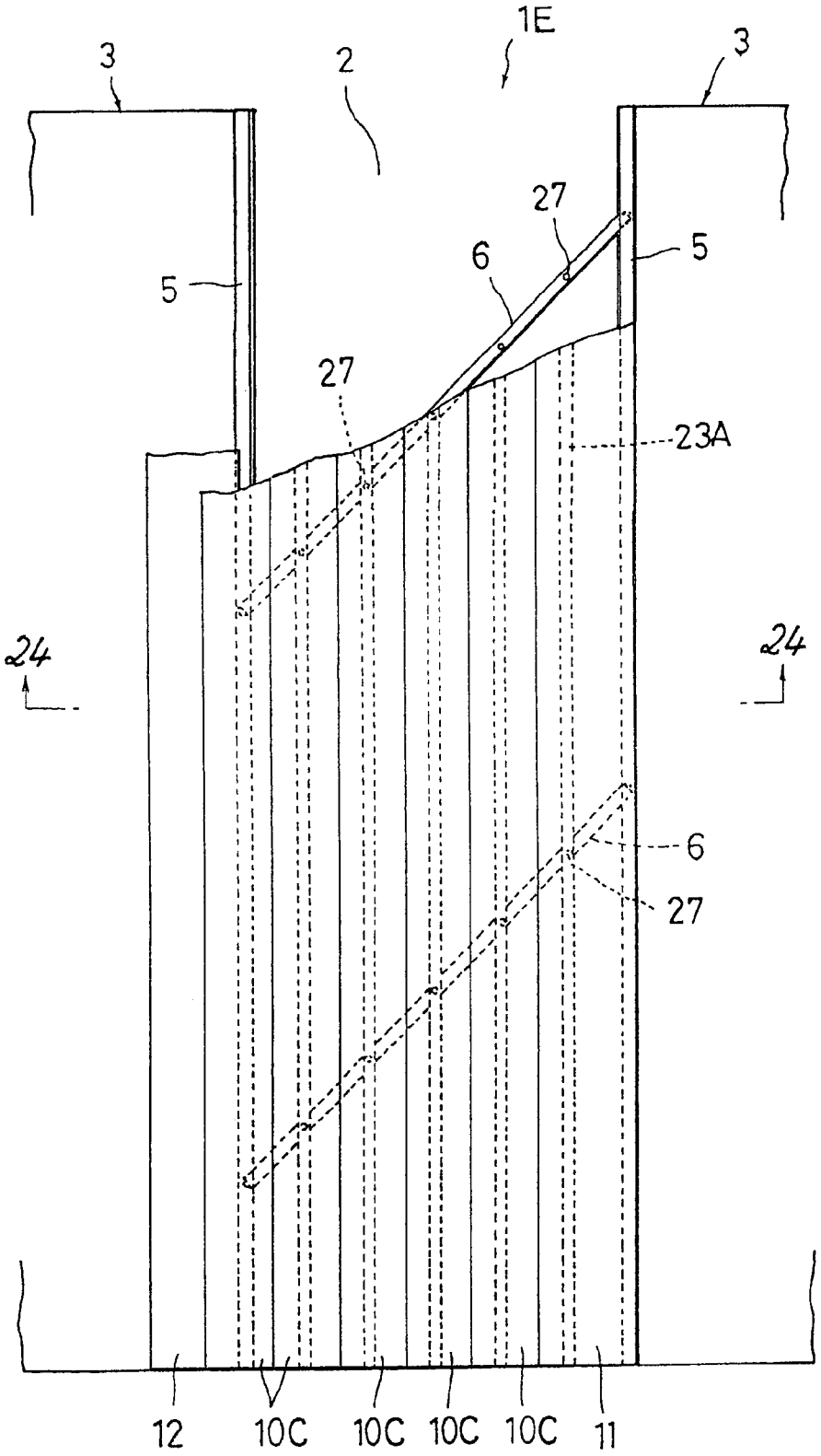
FIG. 23 is a partial cross-sectional plan view showing a sixth embodiment of the present invention.
Figure 24:
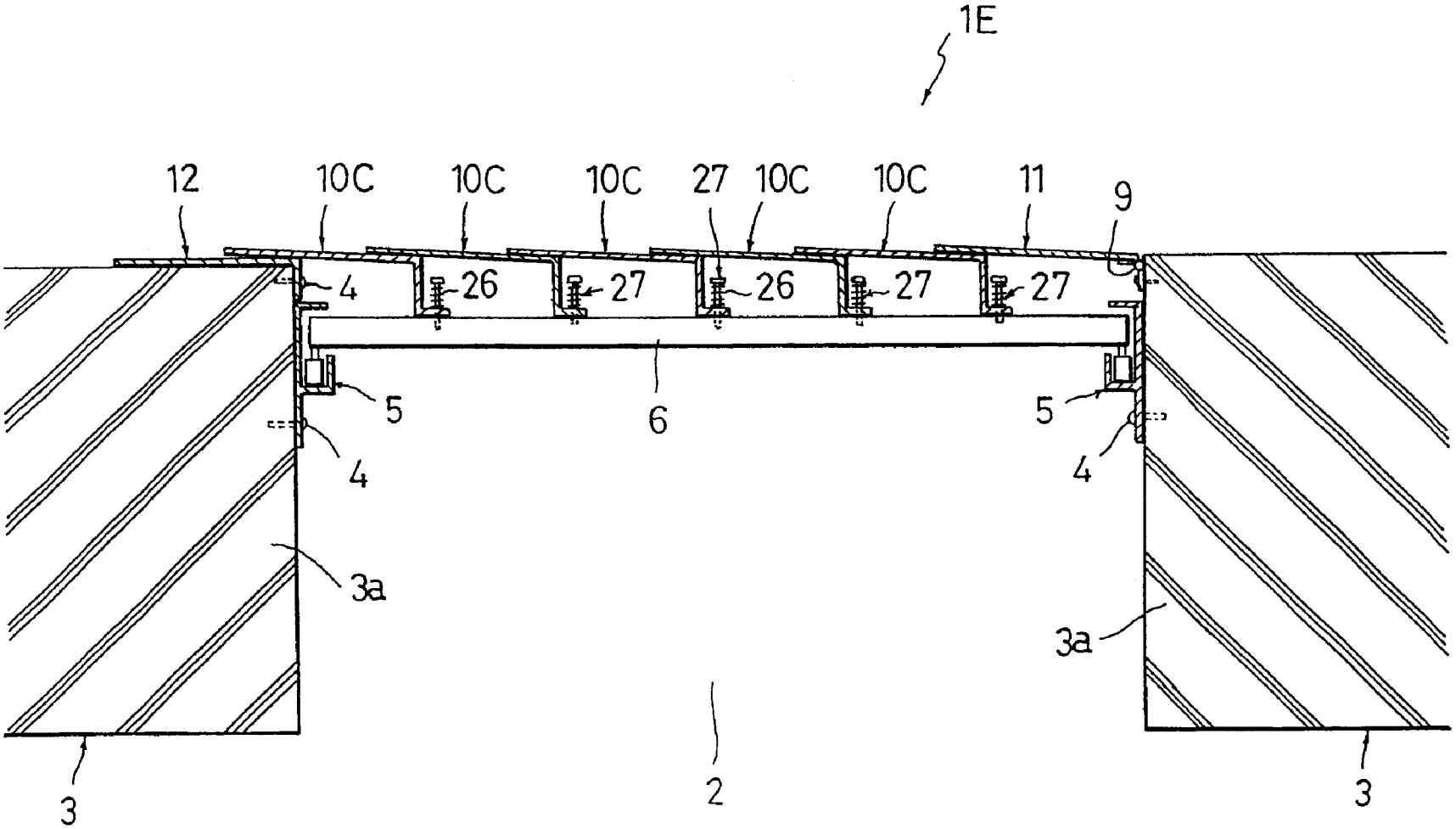
FIG. 24 is an expanded cross-sectional view taken along the line 24-2 of FIG. 23.
Figure 25:
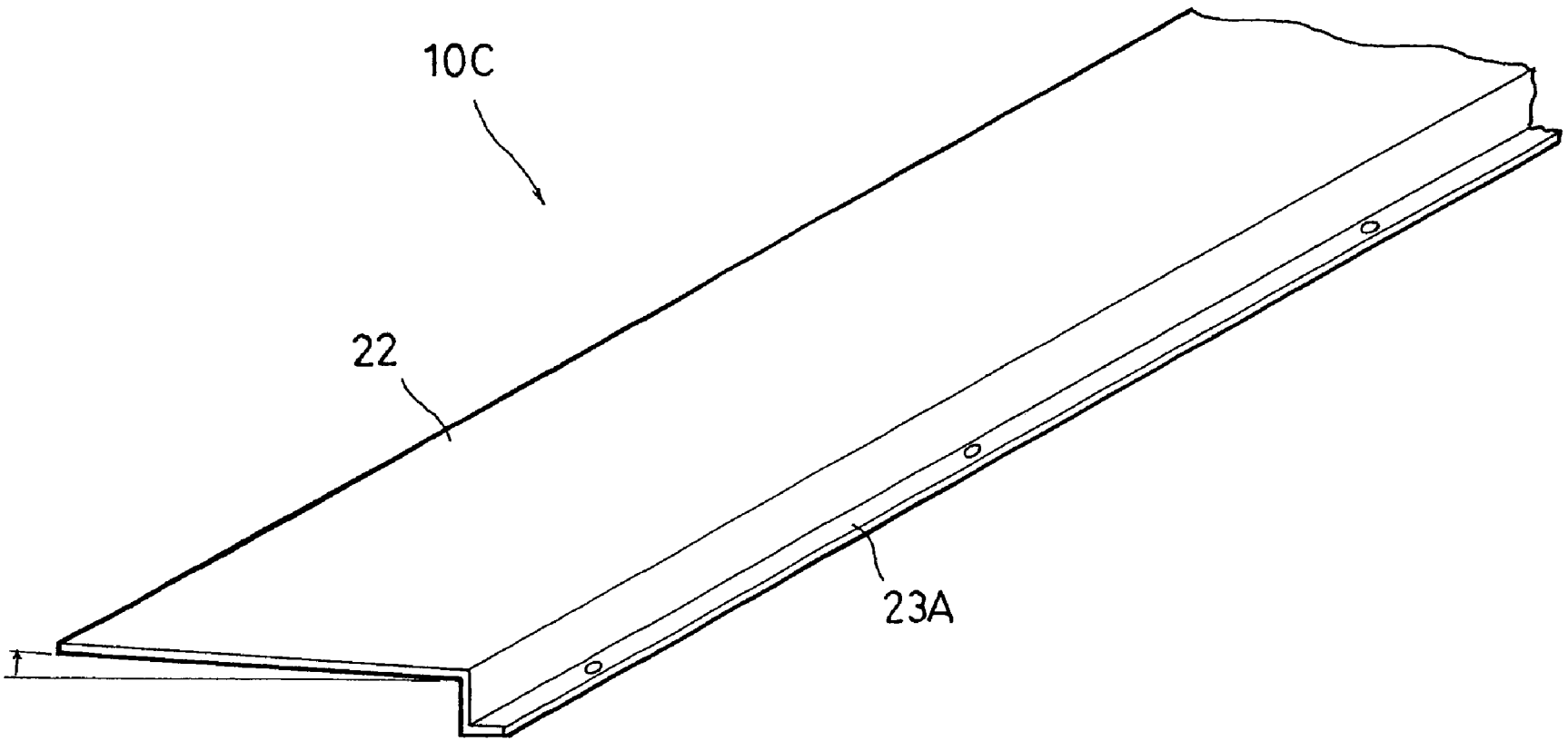
FIG. 25 is an explanatory view of a joint plate of the sixth embodiment of the present invention.

A sixth embodiment of the present invention is shown in FIGS. 23 to 25. It is distinguished from the fourth embodiment by the fact that a plurality of joint plates 10C includes joint plate body 22A respectively upper surface of the joint plate body 22A being sloping surfaces, and the projection 23A of the joint plate 10C is attached pivotably to the support bar 6 by the attachment member 27 including the bolt and biased by the spring 26. A joint device 1E formed in this way according to the sixth embodiment has similar advantages to that according to the fourth embodiment.

Figure 26:
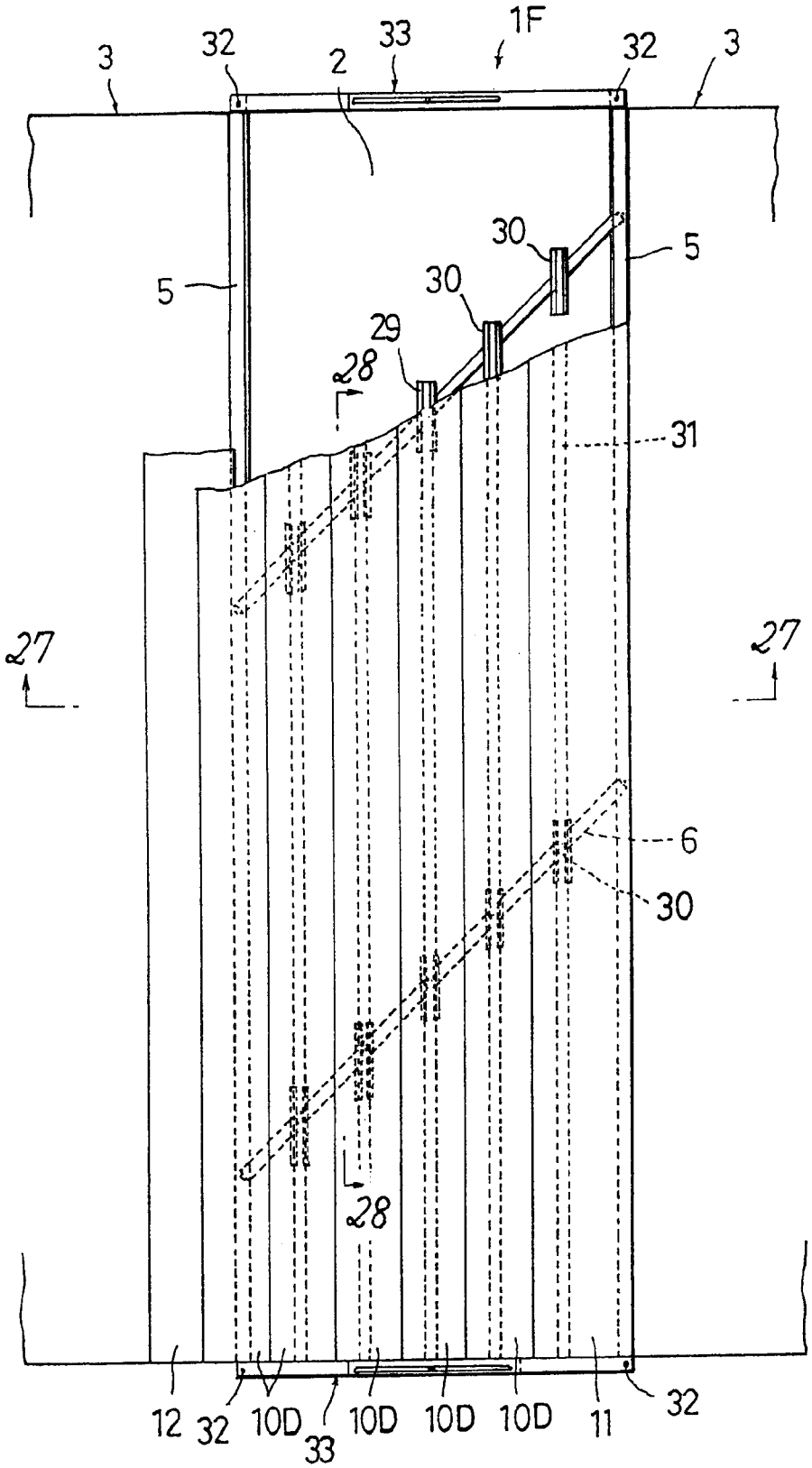
FIG. 26 is a partial cross-sectional plan view showing a seventh embodiment of the present invention.
Figure 27:
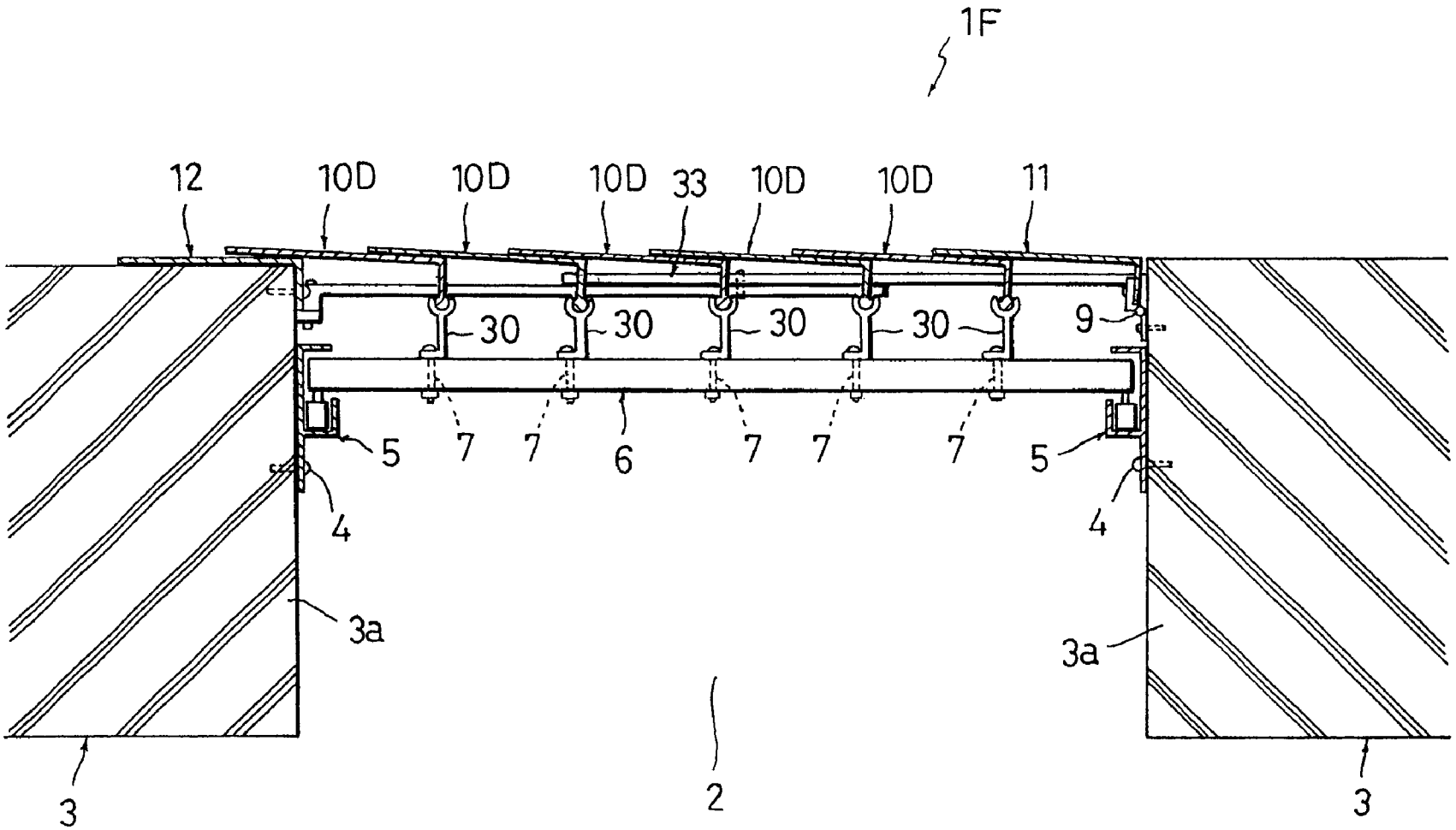
FIG. 27 is an expanded cross-sectional view taken along the line 27—27 of FIG. 26.
Figure 28:
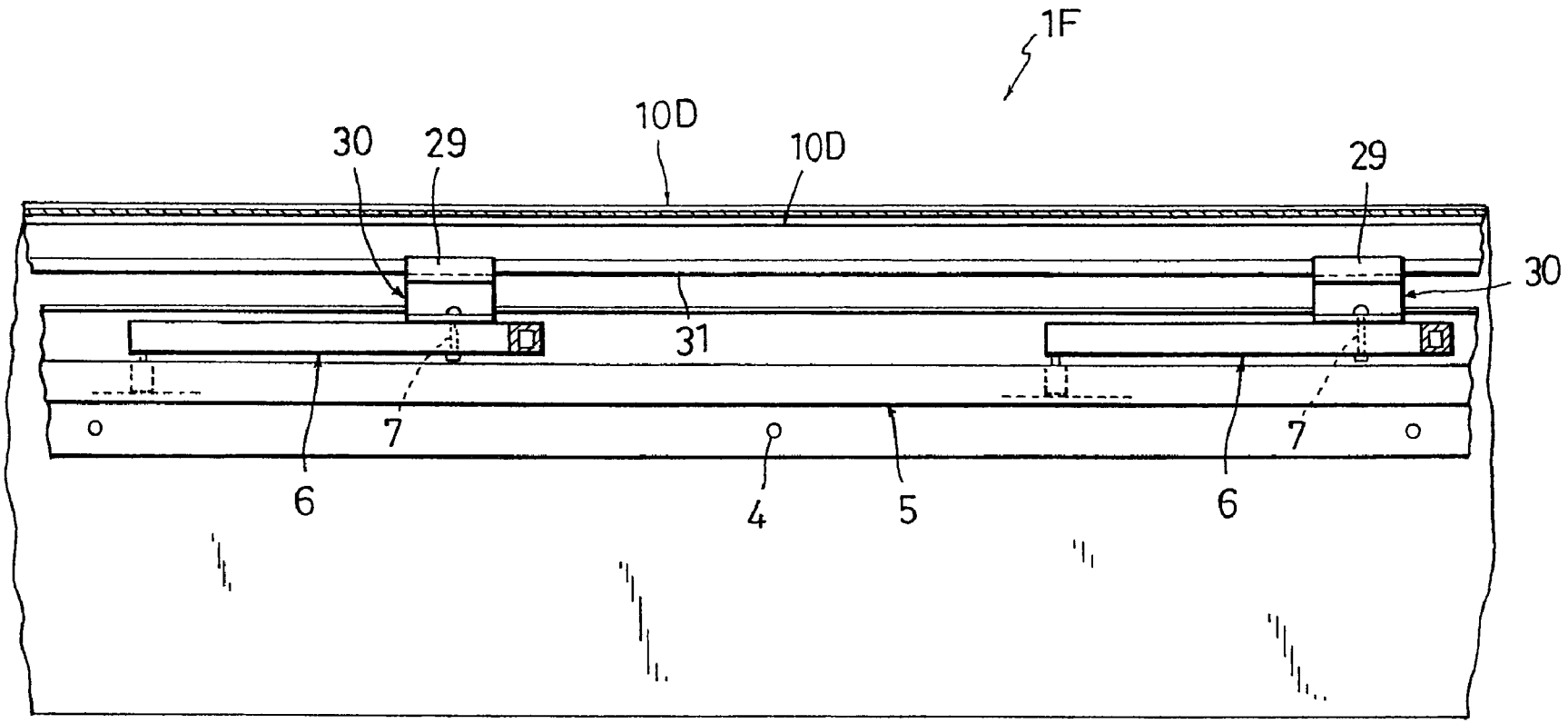
FIG. 28 is an expanded cross-sectional view taken along the line 28—28 of FIG. 26.

A seventh embodiment of the present invention is shown in FIGS. 26 to 28. It is distinguished from the fourth embodiment by the fact that support members 30 for retaining the joint plate include receptor 29 formed in the shape of C-letter on an upper end thereof respectively and attached pivotably to the support bar 6, joint plates 10D include member 31 which is received within the receptor 29, the member 31 being formed in the shape of a sphere in a section being moving rotatably at a fixed range. Members 33,33 of locating the joint plate is extendable and is provided at both ends of the joint plate 10D and attached pivotably to the bodies 3*a*, 3*a* of the building members 3,3 by pivot pins 32,32. A joint device 1F formed in this way according to the seventh embodiment has similar advantages to that according to the fourth embodiment.

Figure 29:
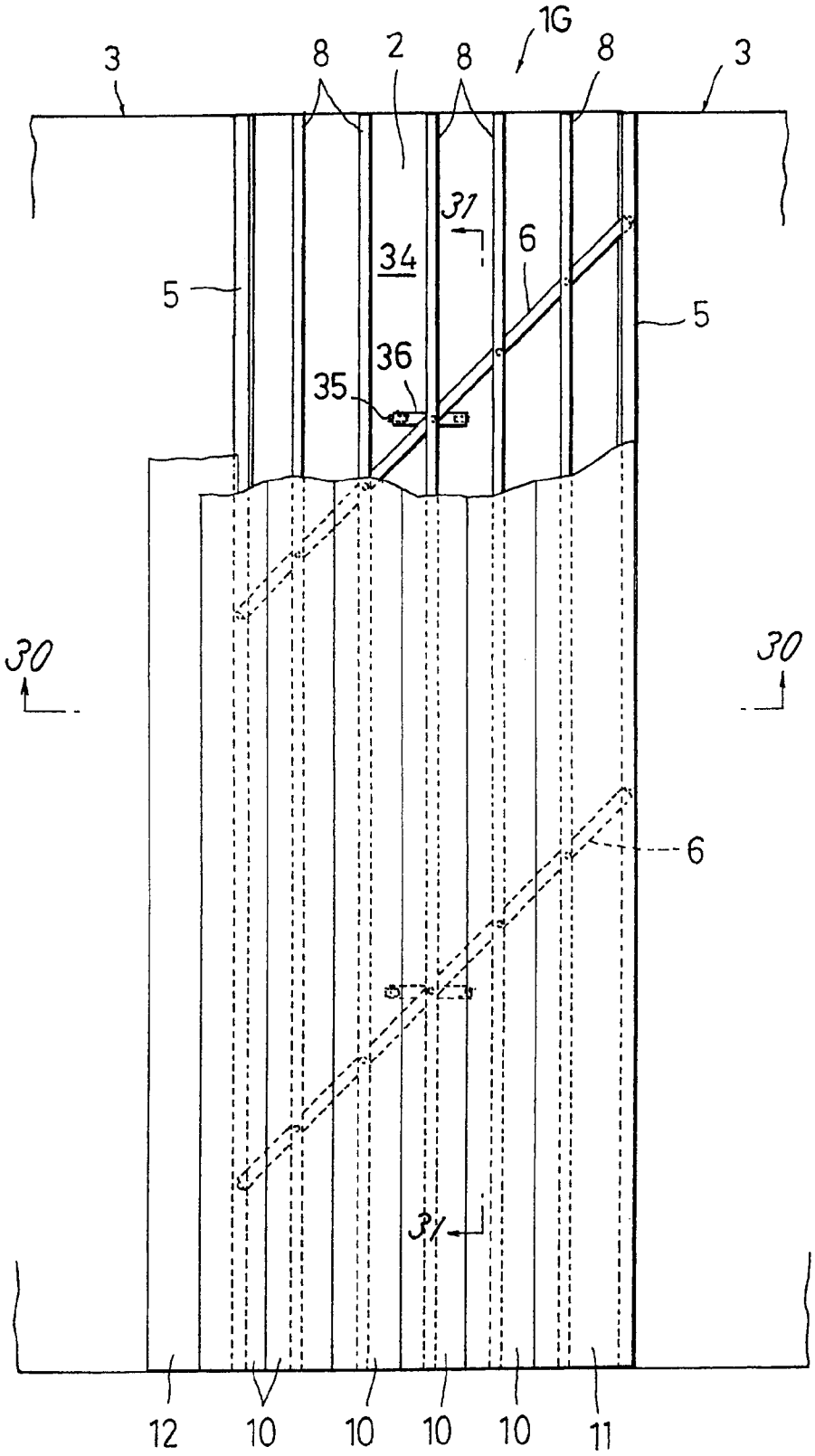
FIG. 29 is a partial cross-sectional plan view showing a eighth embodiment of the present invention.
Figure 30:
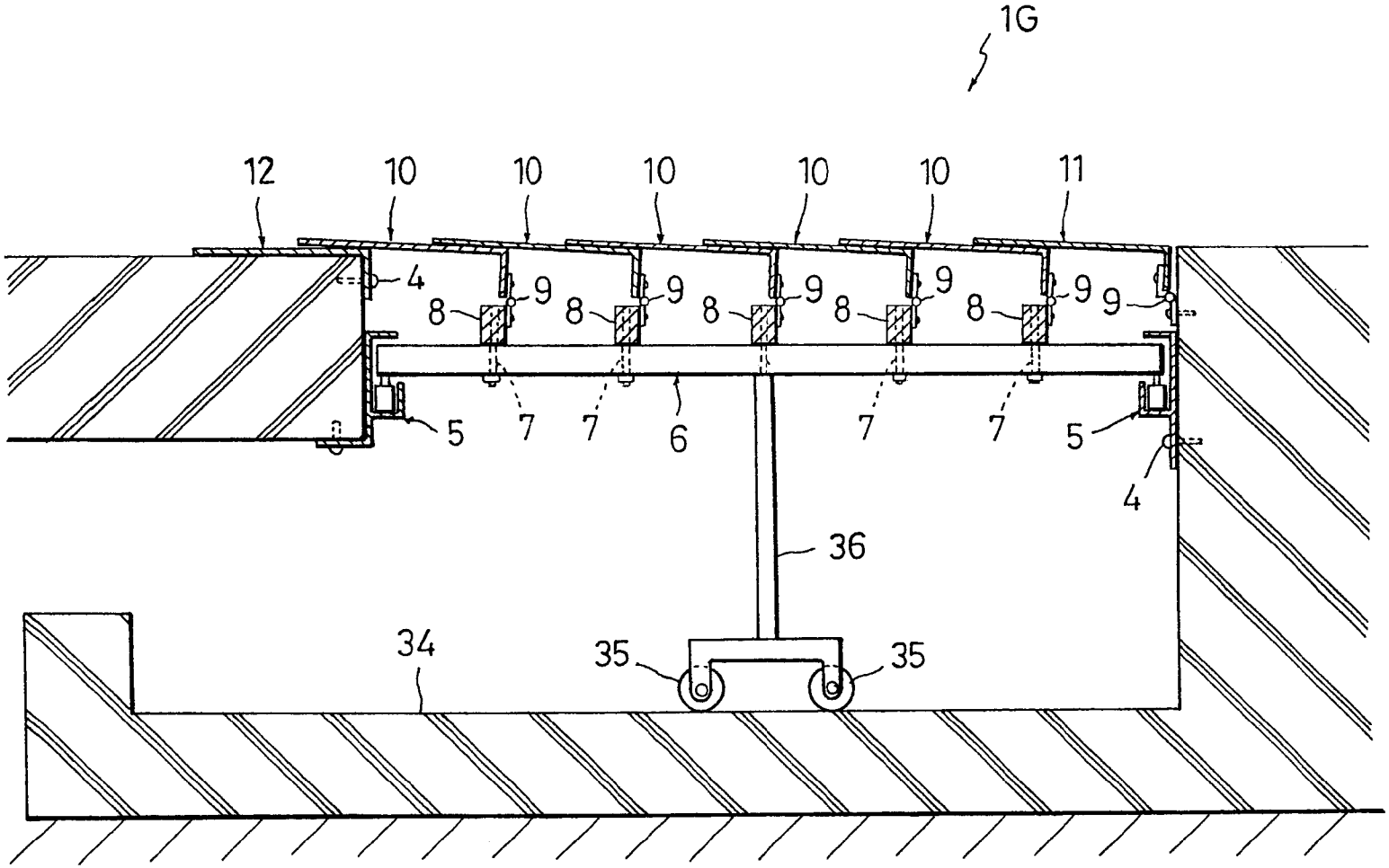
FIG. 30 is an expanded cross-sectional view taken along the line 30—30 of FIG. 29.
Figure 31:
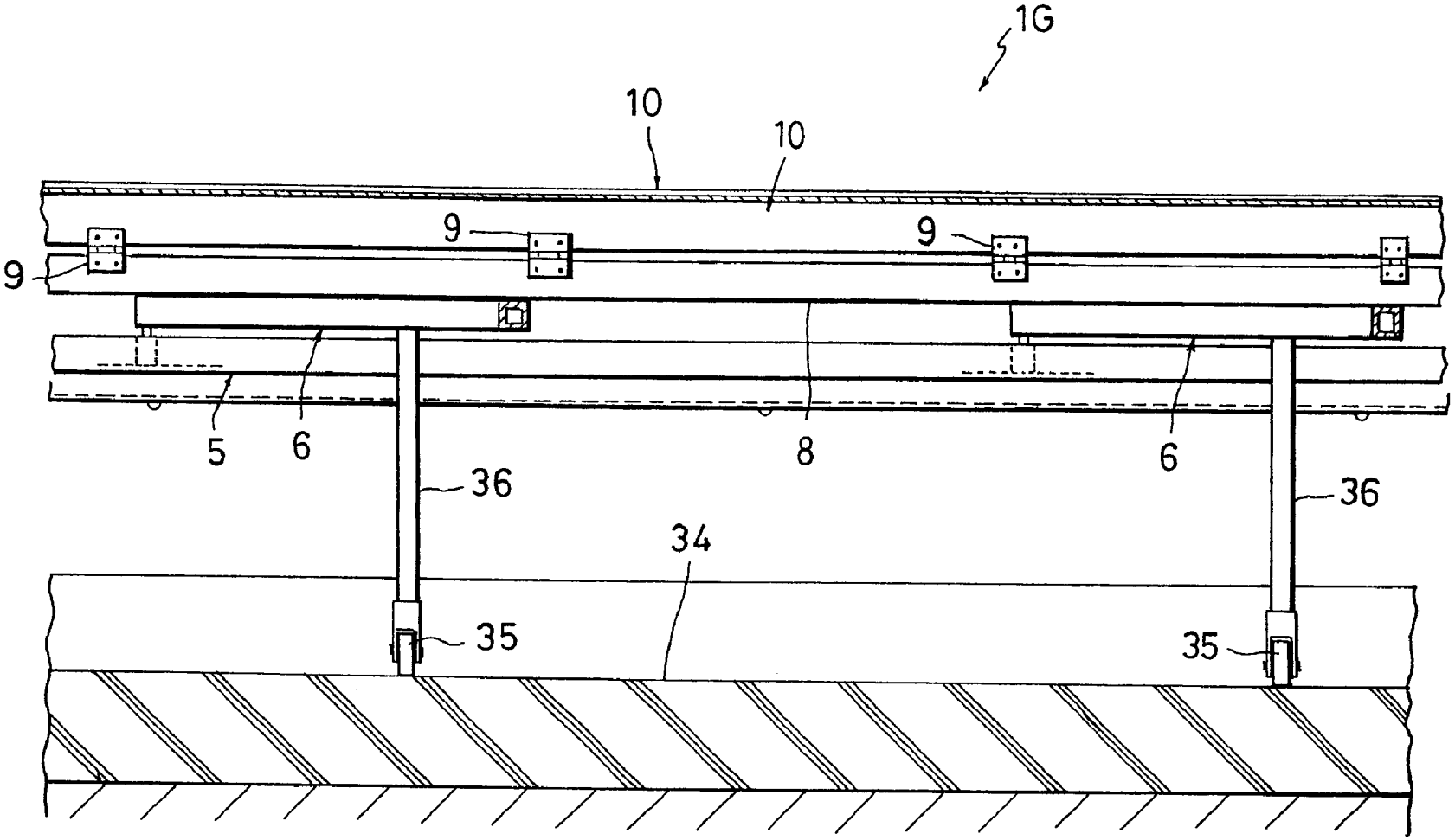
FIG. 31 is an expanded cross-sectional view taken along the line 31—31 of FIG. 29.

An eighth embodiment of the present invention is shown in FIGS. 29 to 31. It is distinguished from the first embodiment by the fact that a floor surface 34 is provided at a lower part between the bodies 3*a*, 3*a* of the joint part side of the building members 3,3, support bar 6 includes a support member 36 which is attached fixedly to a substantially central part thereof, the support member 36 having rollers 35 moves on the floor surface 34. A joint device 1G formed in this way according to the eighth embodiment has similar advantages to that according to the first embodiment.

Figure 32:
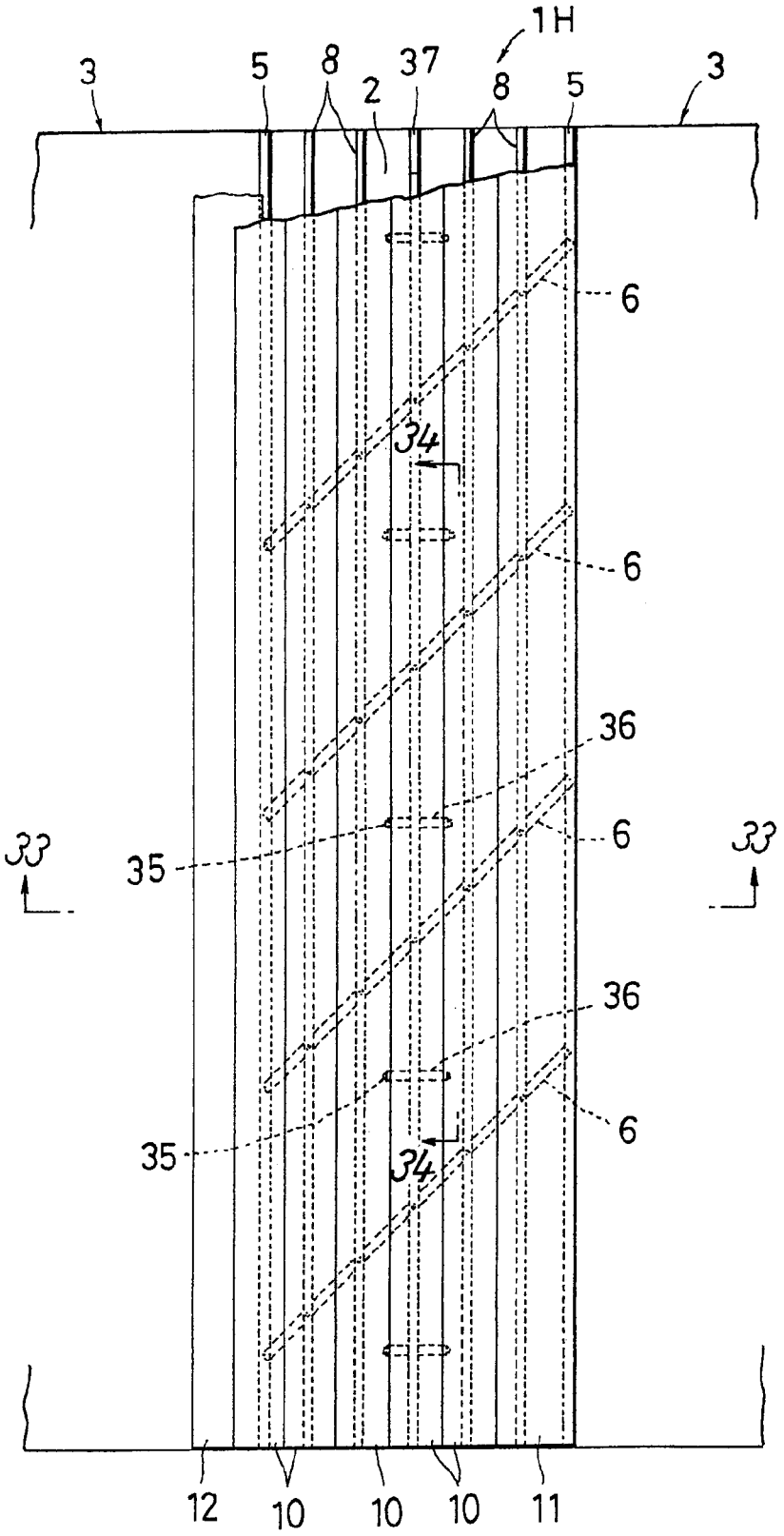
FIG. 32 is a partial cross-sectional plan view showing a ninth embodiment of the present invention.
Figure 33:
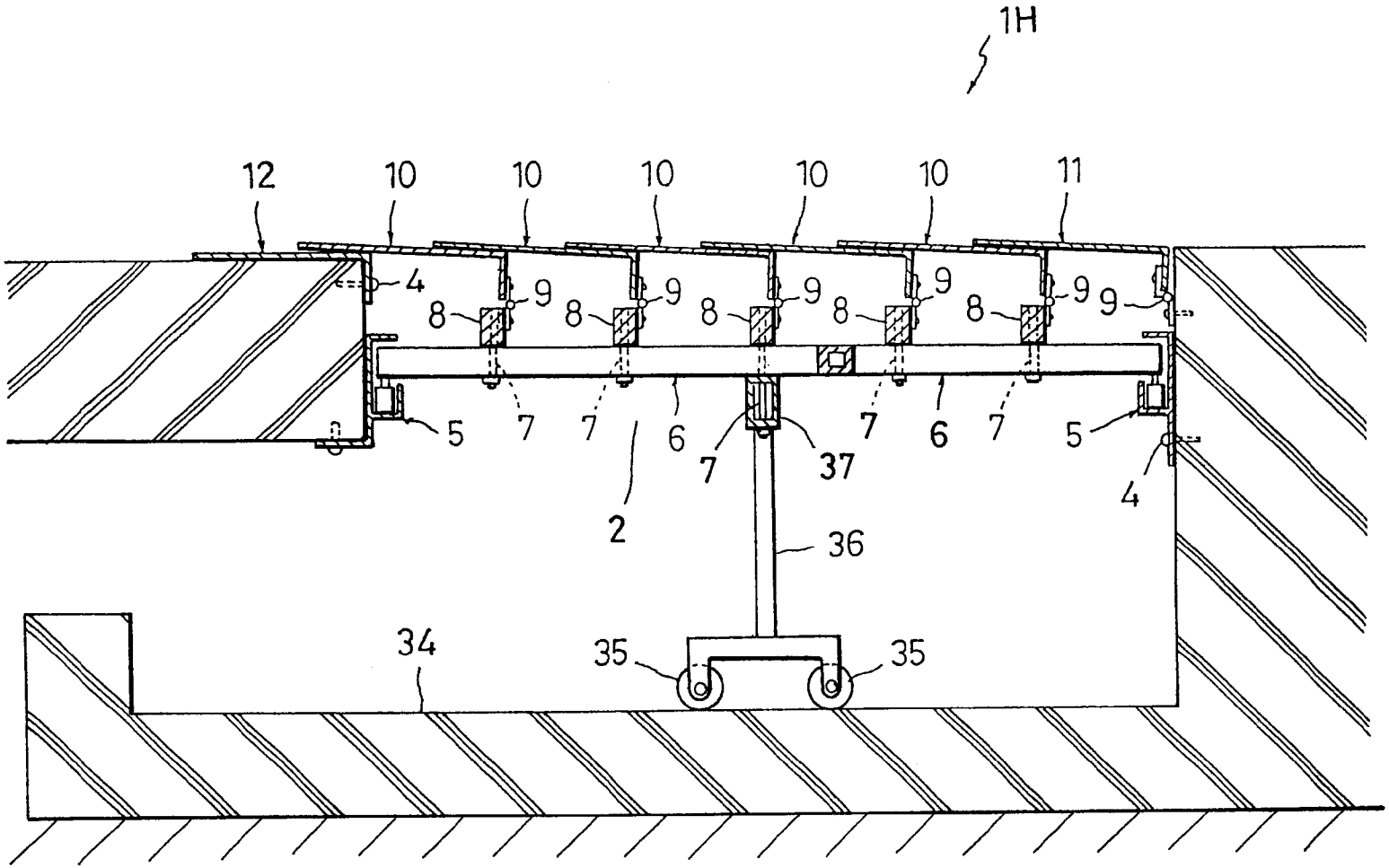
FIG. 33 is an expanded cross-sectional view taken along the line 33—33 of FIG. 32.
Figure 34:
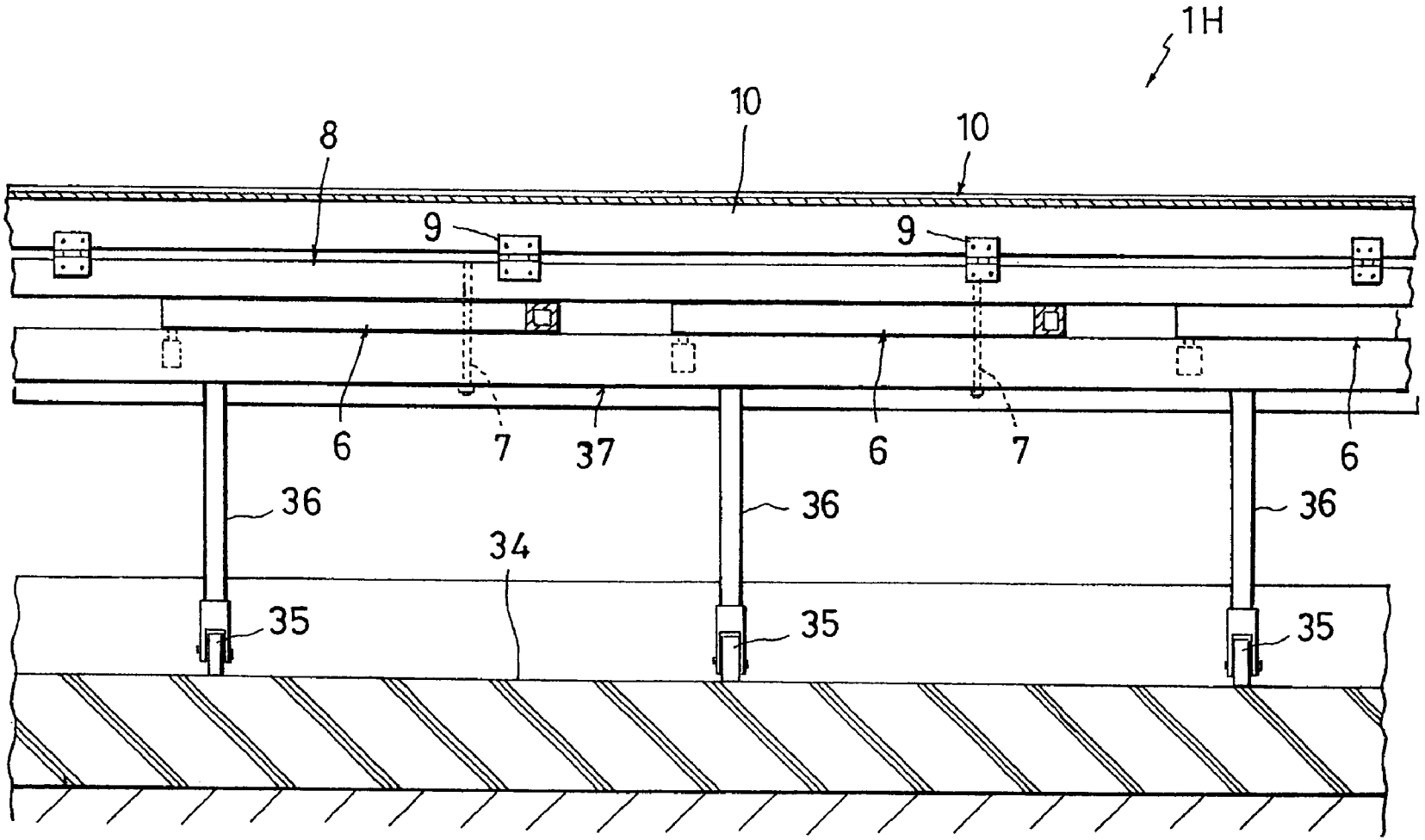
FIG. 34 is an expanded cross-sectional view taken along the line 34—34 of FIG. 32.

A ninth embodiment of the present invention is shown in FIGS. 32 to 34. It is distinguished from the eighth embodiment by the fact that enforcing bars 37 are attached pivotably to a substantially central part thereof by the pivot pins7 respectively, and the support member 36 recant having the rollers 35 is attached fixedly to a fixed part of the enforcing bar 37. A joint device 1H formed in this way according to the ninth embodiment has similar advantages to that according to the eighth embodiment.

Figure 35:
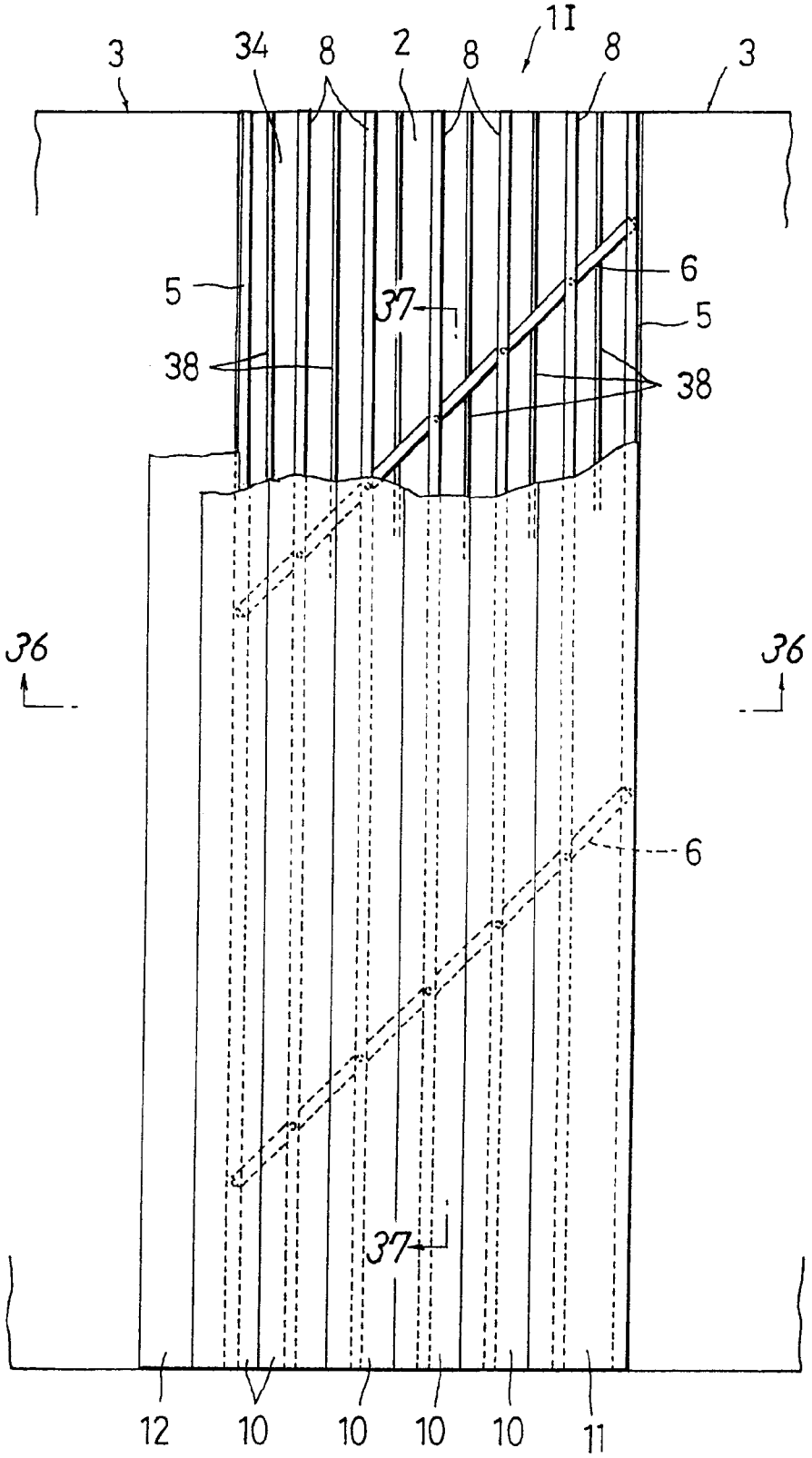
FIG. 35 is a partial cross-sectional plan view showing a tenth embodiment of the present invention
Figure 36:
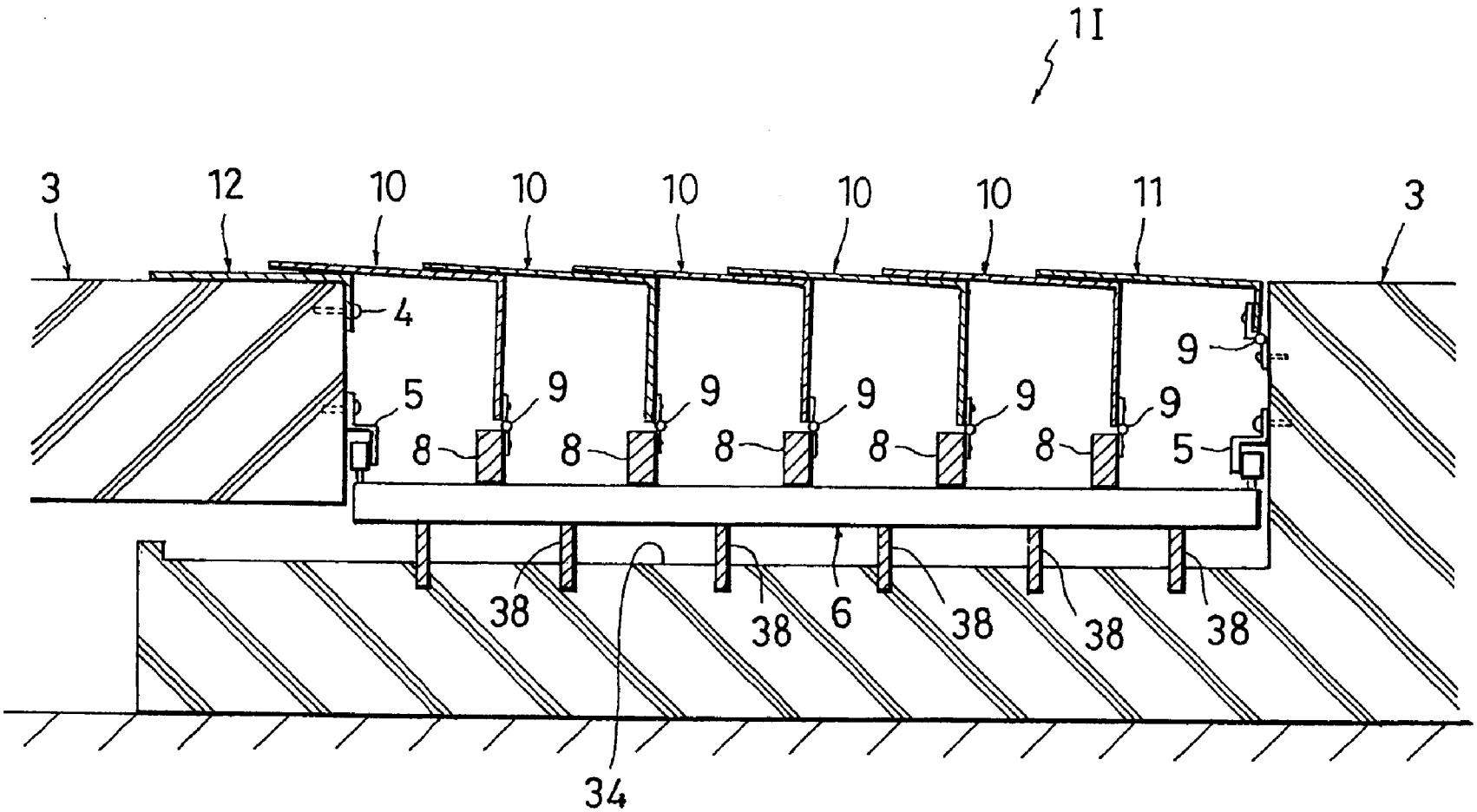
FIG. 36 is an expanded cross-sectional view taken along the line 36—36 of FIG. 35.
Figure 37:
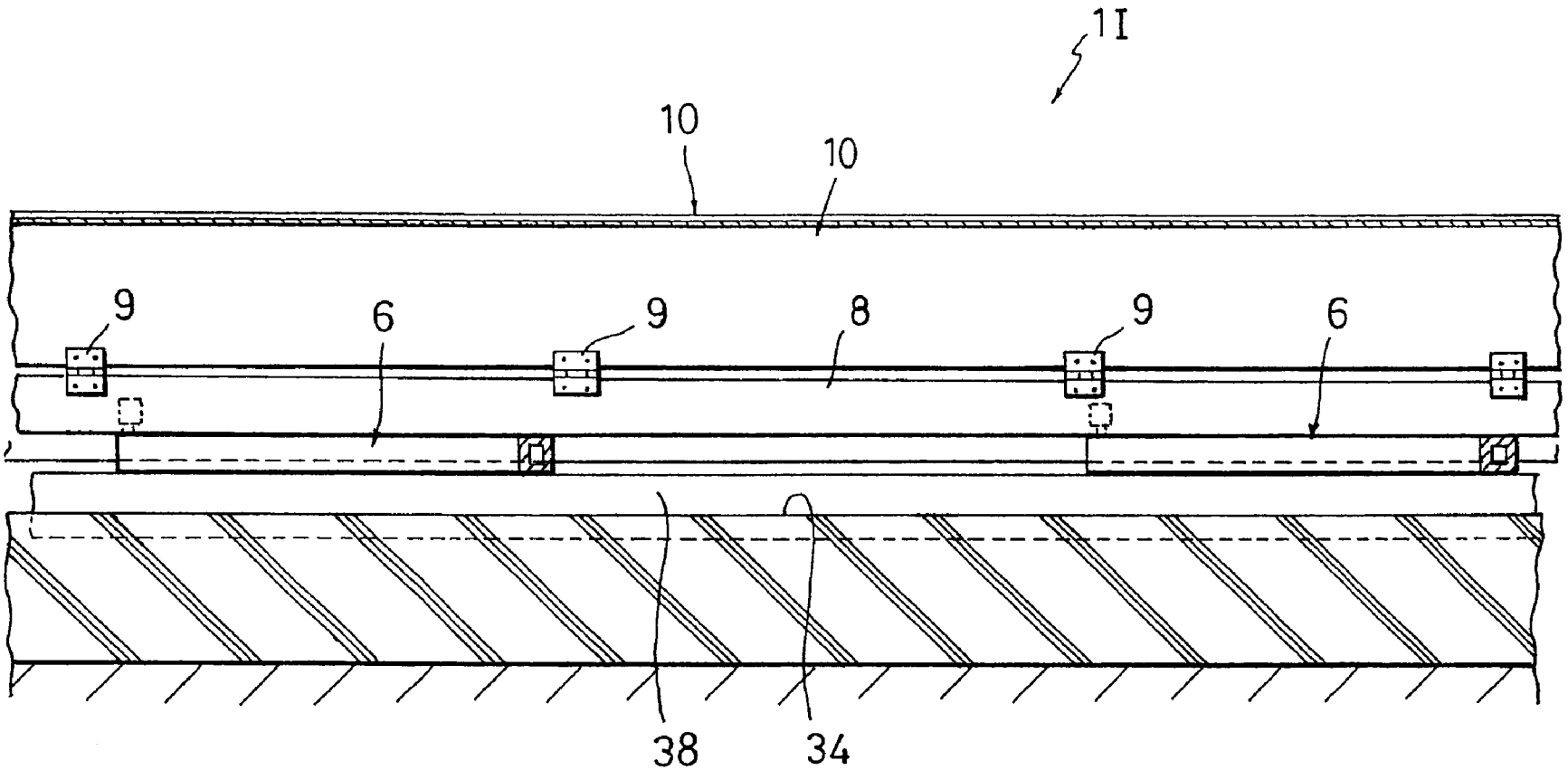
FIG. 37 is an expanded cross-sectional view taken along the line 37—37 of FIG. 35.

A tenth embodiment of the present invention is shown in FIGS. 35 to 37. It is distinguished from the eighth embodiment by the fact that a plurality of slidable support members 38 is provided at the floor surface 34 and supports slidably the support bar 6. A joint device 11 formed in this way according to the tenth embodiment has similar advantages to that according to the eighth embodiment.

As set forth above, the advantages of the invention are as follows:

(1) A joint cover comprises a pair of rails attached to the right and left building portions adjacent sides of the joint parts between the right and left building members; at least two or more support members disposed across a joint gap at a sloping state, both ends thereof being supported movably by the rails attached to the side walls pairs; a plurality of support bars for retaining joint plates provided pivotably at a fixed interval on the support members; and the plurality of joint plates attached to said support bars respectively, each joint plate being overlapping at a fixed width and being maintaining a overlapping state when the width of the joint gap between the two building members expands or contracts, so that the joint gap between the two building members is covered by the plurality of joint plates.

Therefore, as compared with the conventional one piece of joint plate that the size is too big and the weight is too heavy, the transportation and assembly operation can be done efficiently.

(2) As discussed above, the joint cover can move smoothly following swing and oscillation movement by its slidable movement when the two building members are oscillated by an earthquake, or the like, along a back-and forth direction and right-left direction.

(3) As discussed above, the joint cover comprises the rails, at least two or more support members, the plurality of support bars, the plurality of joint plates, so that the number of parts decreases, and it is easy to manufacture.

What is claimed is:

1. A joint cover for covering a joint gap in a floor between a first and a second building portion wherein the joint gap is bounded by side walls, comprising:

at least one rail attached to one of said side walls;

at least two or more support members disposed across said joint gap inclined with respect to said side walls and each having first and second ends, said first and second ends being movably supported on said side walls including said first ends being slidably supported by said at least one rail and said second ends being movably supported to permit at least pivoting motion;

a plurality of support bars provided pivotably mounted at a fixed intervals on said support members; and joint plates movably supported on said support bars respectively to permit upward deflection allowing each of said joint plates to overlap an adjacent one of said joint plates at a fixed width and maintain an overlapping state when the width of the joint gap between said two building portion expands or contracts by sliding and upward deflection.

2. A joint device according to claim 1, wherein said support members have said first ends supported on said at least one rail by rollers.

3. A joint device according to claim 1, wherein said support members are inclined at a 45-degree angle with respect to said side walls.

4. A joint device according to claim 1, wherein said joint plates are pivotably mounted on said support bars to allow movement upward and downward.

5. A joint cover for covering a joint gap in a floor between a first and a second building portion wherein the joint gap is bounded by side walls, comprising:

at least one rail attached to one of said side walls;

at least two or more support members disposed across said joint gap inclined with respect to said side walls and each having first and second ends, said first and second ends being movably supported on said side walls including said first ends being slidably supported by said at least one rail and said second ends being movably supported to permit at least pivoting motion; and joint plates formed in the shape of a crank, being movably supported on said support members respectively to permit upward deflection allowing each of said joint plates to overlap an adjacent one of said joint plates at a fixed width and maintain an overlapping state when the width of the joint gap between said two building portion expands or contracts by sliding and upward deflection.

6. A joint device according to claim 5, wherein said support members have said first ends supported on said at least one rail by rollers.

7. A joint device according to claim 5, wherein said support members are inclined at a 45-degree angle with respect to said side walls.

8. A joint cover for covering a joint gap in a floor between a first and a second building portion wherein the joint gap is bounded by side walls, comprising:

at least one rail attached to one of said side walls;

at least two support members disposed across said joint gap inclined with respect to said side walls and each having first and second ends, said first and second ends being movably supported on said side walls including said first ends being slidably supported by said at least one rail and said second ends being movably supported to permit at least pivoting motion; and joint plates movably supported above said support members respectively to permit upward deflection allowing each of said joint plates to overlap an adjacent one of said joint plates at a fixed width and maintain an overlapping state when the width of the joint gap between said two building portion expands or contracts by sliding and upward deflection.

9. A joint cover according to claim 8 wherein said joint plates have a substantially horizontal top portion, a substantially vertical mid portion, and a substantially horizontal bottom portion mounted to said support members.

10. A joint cover according to claim 8 further comprising a plurality of support bars provided pivotably mounted at a fixed intervals on said support members and effecting said movable support of said joint plates thereon.

11. A joint device according to claim 8, wherein said support members have said first ends supported on said at least one rail by rollers.

12. A joint device according to claim 8, wherein said support members are inclined at a 45-degree angle with respect to said side walls.

* * * * *